US006969582B2

(12) United States Patent
Olm et al.

(10) Patent No.: US 6,969,582 B2
(45) Date of Patent: Nov. 29, 2005

(54) SILVER HALIDE EMULSION CONTAINING IRIDIUM DOPANT

(75) Inventors: Myra T. Olm, Webster, NY (US); Woodrow G. McDugle, Jr., Rochester, NY (US); Jeffrey C. Hansen, Fairport, NY (US); Thomas D. Pawlik, Rochester, NY (US); John D. Lewis, Webster, NY (US); Jerzy Z. Mydlarz, Rochester, NY (US); Robert D. Wilson, Rochester, NY (US); Eric L. Bell, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 40 days.

(21) Appl. No.: 10/826,708

(22) Filed: Apr. 16, 2004

(65) Prior Publication Data

US 2005/0233266 A1 Oct. 20, 2005

(51) Int. Cl.[7] ..... G03C 1/005; G03C 1/494
(52) U.S. Cl. ..... 430/567; 430/604; 430/605
(58) Field of Search ..... 430/567, 599, 430/604, 605

(56) References Cited

U.S. PATENT DOCUMENTS 5,360,712 A * 11/1994 Olm et al. ..... 430/567
5,457,021 A * 10/1995 Olm et al. ..... 430/604
5,462,849 A * 10/1995 Kuromoto et al. ..... 430/567
6,107,018 A * 8/2000 Mydlarz et al. ..... 430/605

* cited by examiner

*Primary Examiner*—Geraldine Letscher
(74) *Attorney, Agent, or Firm*—Andrew J. Anderson

(57) ABSTRACT

A silver halide emulsion comprising radiation sensitive silver halide grains exhibiting a face centered cubic crystal lattice structure containing a hexacoordination complex of an iridium ion in which at least half of the coordination sites in the hexacoordination complex are provided by halogen or pseudohalogen ligands, and at least one coordination site is provided by a ligand comprising a azole ring containing a chalcogen atom and a nitrogen atom, wherein the azole ring is substituted at the 5-position with a halide ion. The invention provides emulsions containing with a preferred class of iridium dopants which are especially useful for improving reciprocity performance in silver halide emulsions with minimal or no impact on other aspects of photographic performance. These dopants give a superior balance of reciprocity and other photographic properties compared to other iridium dopants exemplified in the prior art.

30 Claims, No Drawings

SILVER HALIDE EMULSION CONTAINING IRIDIUM DOPANT

FIELD OF THE INVENTION

This invention relates to photography, including photothermography. More specifically, it relates to photographic silver halide emulsions and processes for their preparation. These emulsions can comprise the imaging element of a conventionally developed photographic film or paper or of a thermally developable imaging system.

DEFINITION OF TERMS

The term "pseudohalide" refers to groups known to approximate the properties of halides—that is, monovalent anionic groups sufficiently electronegative to exhibit a positive Hammett sigma value at least equaling that of a halide—e.g., $CN^-$, $OCN^-$, $SCN^-$, $SeCN^-$, $TeCN^-$, $N_3^-$, $C(CN)_3^-$ and $CH^-$.

The term "C—C, H—C or C—N—H organic" refers to groups that contain at least one carbon-to-carbon bond, at least one carbon-to-hydrogen bond or at least one carbon-to-nitrogen-to-hydrogen bond sequence.

The terms "high chloride" and "high bromide" in referring to silver halide grains and emulsions indicates that chloride or bromide, respectively, is present in a concentration of greater than 50 mole percent, based on total silver.

In referring to grains and emulsions containing two or more halides, the halides are named in order of ascending concentrations.

All references to the periodic table of elements periods and groups in discussing elements are based on the Periodic Table of Elements as adopted by the American Chemical Society and published in the *Chemical and Engineering News*, Feb. 4, 1985, p. 26. The term "Group VIII" is used to generically describe elements in groups 8, 9 and 10.

The term "cubic grain" is employed to indicate a grain is that bounded by six {100} crystal faces. Typically the corners and edges of the grains show some rounding due to ripening, but no identifiable crystal faces other than the six {100} crystal faces. The six {100} crystal faces form three pairs of parallel {100} crystal faces that are equidistantly spaced.

The term "cubical grain" is employed to indicate grains that are at least in part bounded by {100} crystal faces satisfying the relative orientation and spacing of cubic grains. That is, three pairs of parallel {100} crystal faces are equidistantly spaced. Cubical grains include both cubic grains and grains that have one or more additional identifiable crystal faces. For example, tetradecahedral grains having six {100} and eight {111} crystal faces are a common form of cubical grains.

The term "tabular grain" indicates a grain having two parallel major crystal faces (face which are clearly larger than any remaining crystal face) and having an aspect ratio of at least 2.

The term "aspect ratio" designates the ratio of the equivalent circular diameter of a major face to grain thickness.

The term "equivalent circular diameter" in referring to silver halide grains refers to the diameter of a circle which has the same area as the projected area of an individual grain.

The term "tabular grain emulsion" refers to an emulsion in which tabular grains account for greater than 50 percent of total grain projected area.

The term "dopant" is employed to indicate any material within the rock salt face centered cubic crystal lattice structure of a silver halide grain other than silver ion or halide ion.

The term "log E" is the logarithm of exposure in lux-seconds.

Speed is reported as relative log speed, where 1.0 relative log speed units is equal to 0.01 log E.

The term "contrast" or "γ" is employed to indicate the slope of a line drawn from stated density points on the characteristic curve.

The term "reciprocity law failure" refers to the variation in response of an emulsion to a fixed light exposure due to variation in the specific exposure time.

The term "high intensity reciprocity failure" or "HIRF" refers to reciprocity law failure observed for short high intensity exposures.

The term "low intensity reciprocity failure" or "LIRF" refers to reciprocity law failure observed for long low intensity exposures.

The term "latent image keeping" or "LIK" refers to the variation in response of an emulsion to the delay between exposure and development.

*Research Disclosure* is published by Kenneth Mason Publications, Ltd., Dudley House, 12 North St., Emsworth, Hampshire P010 7DQ, England.

BACKGROUND OF THE INVENTION

Metals introduced during silver halide grain nucleation and/or growth can enter the grains as dopants, and may modify photographic properties of the emulsion grains, depending on their level and location within the grains. When the metal forms a part of a coordination complex, such as a hexacoordination complex or a tetracoordination complex, the ligands can also be occluded within the grains. The presence of such coordination ligands can vary emulsion properties further. The use of dopants in silver halide grains to modify photographic performance is well know in the photographic art, as generally illustrated, e.g., by *Research Disclosure*, Item 38957, I. Emulsion grains and their preparation, D. Grain modifying conditions and adjustments, paragraphs (3)–(5). Photographic performance attributes known to be affected by dopants include sensitivity, reciprocity failure, and contrast.

Doping with iridium is commonly performed to reduce reciprocity law failure in silver halide emulsions. According to the photographic law of reciprocity, a photographic element should produce the same image with the same exposure, even though exposure intensity and time are varied. For example, an exposure for 1 second at a selected intensity should produce exactly the same result as an exposure of 2 seconds at half the selected intensity. When photographic performance is noted to diverge from the reciprocity law, this is known as reciprocity failure.

Reduced reciprocity failure of silver halide emulsions is important in most, if not all of the silver halide based photographic or imaging systems. Such systems include color and black and white negative film and paper, color reversal film, photothermographic imaging materials, direct x-ray imaging materials, and graphic arts imaging systems. Of course, the time regime over which it is important to have invariant photosensitivity varies from application to application. Thus, doping strategies can depend on the intended use of the doped emulsion. Additionally, since good reciprocity performance is often obtained at the expense of some other desirable photographic response, such as high speed, or negligible latent image keeping, doping strategies are chosen based on the desired feature set of the system in which the emulsion will be used.

In high speed color negative film, it is important to have reduced high intensity reciprocity failure (HIRF) to accommodate short flash exposures and it is important to accomplish this with minimal reduction of film sensitivity (<0.05 log E) for normal exposures, but it is typically not important to have good latent image keeping (LIK) for times less than 24 hours. In color negative paper for optical printing, on the other hand, it is desirable to have both reduced high intensity reciprocity failure and to provide good LIK for times shorter than 24 hours, but it is less important to maintain maximum paper sensitivity.

Iridium salts have long been added to silver halide emulsion grains, at levels typically ranging from about $1\times10^{-9}$ to $1\times10^{-5}$ mole/mole Ag, as a means of improving high intensity and low intensity reciprocity failure. Iridium salts of general formula $[Ir(X)_{6-n}L_n]^{3-/2-}$ where X=Br or Cl, L=$H_2O$, and n=0, 1, or 2 have been widely used as reciprocity-controlling dopants.

The recognition by Olm et al, U.S. Pat. No. 5,360,712, that metal hexa-coordination and tetra-coordination complexes having at least one organic ligand and at least half of the metal coordination sites occupied by halide or pseudo-halide ligands could be incorporated into the silver halide lattice expanded the number of possible transition metal complexes available for use as dopants for silver halides, including those available for use as reciprocity controlling dopants. This recognition was based on the discovery, described in U.S. Pat. No. 5,360,712, that the selection of the C—C, H—C or C—N—H organic ligands is not limited by steric considerations in the manner indicated previously by Janusonis et al U.S. Pat. No. 4,835,093; McDugle et al U.S. Pat. Nos. 4,933,272, 4,981,781 and 5,037,732; Marchetti et al U.S. Pat. No. 4,937,180; and Keevert et al U.S. Pat. No. 4,945,035. Each of these patents teaches replacing a single halide ion the crystal lattice structure with a non-halide ligand occupying exactly the same lattice position. In fact, the variation of steric forms of C—C, H—C or C—N—H organic ligands observed led to the conclusion that neither the steric form nor size of the organic ligand is in itself a determinant of photographic utility.

U.S. Pat. No. 5,360,712 also teaches that to achieve performance modification attributable to the presence of the organic ligands at least half of the coordination sites provided by the metal ions must be occupied by pseudo-halide, halide or a combination of halide and pseudo-halide ligands. When the organic ligands occupy all or even the majority of coordination sites in the complex, photographic modifications attributable to the presence of the organic ligand were not identified.

The teachings in U.S. Pat. No. 5,360,712 greatly expanded the pool of potentially useful metal coordination complex dopants for silver halide photographic emulsions. With regard to iridium dopants for reciprocity control, U.S. Pat. No. 5,360,712 teaches significant reductions in HIRF are produced by the incorporation as a grain dopant of iridium complexes containing an acetonitrile, pyridazine, thiazole or pyrazine ligand. Additionally, these complexes are capable of significantly reducing LIRF. The synthesis, proof of incorporation and photographic effects of iridium dopants with thiazole ligands were demonstrated in examples describing the dopant $K_2IrCl_5$(thiazole).

Kuromoto et al., U.S. Pat. No. 5,462,849 specifically demonstrated that the number of preferred iridium dopants capable of reducing HIRF and LIRF could be expanded still further by use of substituted thiazole ligands or by the use of multiple thiazole ligands. Specific examples of the synthesis of the following iridium dopants were disclosed (tz=thiazole):

MC-49 $K[IrCl_4\ (tz)_2]$
MC-50 $K_2\ [IrBr_5\ (tz)]$
MC-51 $K[IrBr_4\ (tz)_2]$
MC-52 $K[IrCl_4\ (H_2O)(tz)]$
MC-53 $K[IrCl_4$ (4-methylthiazole)$_2]$
MC-54 $K_2\ [IrCl_5$ (5-methylthiazole)]
MC-55 $K[IrCl_4$ (5-methylthiazole)$_2]$
MC-56 $K[IrCl_4$ (4,5-dimethylthiazole)$_2]$
MC-57 $K[IrCl_4$ (2-bromothiazole)$_2]$ An example demonstrating incorporation was shown for MC-54. Examples showing the positive effects of dopants MC-50 to MC-57 on HIRF and LIRF were also shown.

Mydlarz et al U.S. Pat. No. 6,107,018 describes co-doping silver halide grains with a "class (i)" dopant defined as a dopant capable of providing shallow electron trapping sites and a "class (ii)" dopant which is an iridium coordination complex containing at least one thiazole or substituted thiazole ligand. Co-doping provided greater reduction in reciprocity law failure than could be achieved with either dopant alone and this reduction was beyond the simple additive sum achieved when employing either dopant class by itself. Mydlarz teaches that the thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. Mydlarz also teaches that the class (ii) dopant preferably is an iridium coordination complex having ligands each of which are more electropositive than a cyano ligand. In a specifically preferred form the remaining non-thiazole or non-substituted thiazole ligands of the coordination complexes forming class (ii) dopants are halide ligands. Mydlarz lists the following specific illustrations of iridium thiazole dopants:

(ii-1) $[IrCl_5$ (thiazole)$]^{2}$
(ii-2) $[IrCl_4$ (thiazole)$_2]^{-1}$
(ii-3) $[IrBr_5$ (thiazole)$]^{-2}$
(ii-4) $[IrBr_4$ (thiazole)$_2]^{-1}$
(ii-5) $[IrCl_4$ (5-methylthiazole)$_2]^{-2}$
(ii-6) $[IrCl_4$ (5-methylthiazole)$_2]^{-1}$
(ii-7) $[IrBr_5$ (5-methylthiazole)$]^{-2}$
(ii-8) $[IrBr_4$ (5-methylthiazole)$_2]^{-1}$ Most iridium dopants are electron-trapping dopants. Electron-trapping dopants affect photographic properties because they trap electrons produced by exposure and then release the electrons. Different electron-trapping dopants can have different electron release profiles, that is, the electrons can be released from the dopant trap over a very narrow time period or a long time period. Additionally, the average time between electron trapping and release can vary from milliseconds to days. As a subclass of electron-trapping dopants, iridium dopants are generally useful in controlling reciprocity because they release electrons in the time frame in which latent image is formed (secs to minutes). The released electrons are incorporated into latent image centers. In iridium-doped emulsions, the time frame of latent image formation is shifted or expanded compared to undoped grains. It is this change in the time frame of latent image formation that leads to reduced reciprocity failure.

In designing an emulsion for a particular product, iridium dopants must be chosen to eliminate reciprocity failure in a time regime appropriate for intended use of the final product. The dopants must also be chosen so as to achieve an optimum trade-off of reciprocity control and with other desirable photographic features such as speed or LIK. As noted above, the final use of the product dictates which photographic features must be balanced with reciprocity control. Quite small changes in electron release profiles and average trapped electron lifetime can affect the final performance dramatically, thus, in optimizing reciprocity performance with other photographic parameters, it is desirable to be able to make small changes in dopant trapping properties. This can be achieved by keeping the central metal ion constant and varying the dopant ligand structure. Referring to iridium dopants with organic ligands, M. T. Olm, R. S. Eachus, W. G. McDugle, R. C. Baetzold state, in Proceedings of the 2000 International Symposium on Silver Halide Technology, Quebec, ISBN: 0-89208-229-1 "These dopants have trapping properties that are not dramatically different from those of $(IrCl_6)^{3-}$ and so are useful for improving reciprocity behavior with varying effects on other photographic features."

The intended use of the final product also dictates the choice of emulsion halide composition. For example, high chloride emulsions are typically used in color paper applications because they develop rapidly. Alternatively, AgBrI emulsions are typically used in color negative film applications because (i) light absorption is enhanced by the presence of iodide for blue-sensitized emulsions, (ii) sensitizing dyes are more readily absorbed onto the AgBrI surfaces compared to AgCl surfaces, and (iii) the presence of iodide in the emulsion allows for partial development of the grain which reduces graininess in the film. The halide composition of the emulsion and the surface morphology can also affect the choice of iridium dopant. As pointed out by Eachus and Olm in J. Soc. Photogr. Sci. Japan Vol. 54, No. 3, p 294-301 (1991), "The lifetime of the impurity center produced by electron trapping is obviously important to the photographic process. It is affected by the identity of the central metal ion, its valence state, the composition of the ligand shell and the composition of the host lattice."

Based on the teachings and examples of Olm, Kuromoto and Mydlarz, cited above, the most effective organic ligands for use with iridium dopants for reducing HIRF were azoles, with optimum results having been achieved with thiazole ligands. Preferred iridium dopant candidates for reducing reciprocity failure can be chosen from iridium complexes where at least half the ligand shell is comprised of halide ions or pseudohalide ions and the remaining contain at least one thiazole or substituted thiazole ligand. Exemplified compounds have one or two thiazole ligands. Aquated species were also specifically contemplated as demonstrated by compound MC-52. Especially preferred substituents on thiazole ligands were reported to be lower alkyls, specifically methyl. Bromide substituents, as exemplified by compound MC-57, were also specifically contemplated. All of the thiazole substituents are bound to Ir through the nitrogen at position 3. Substitution of the thiazole substituent at the 2, 4 and 5 positions were specifically contemplated as demonstrated by compounds MC-53 to MC-57. Most of these prior art teachings are exemplified by high chloride emulsions designed for color paper products. The only specific examples for high bromide emulsions are for the dopants $K_4$ $[Ir_2$ $Cl_{10}(pyz)]$ and $Na_3$ $K_2$ $[IrCl_5$ $(pyz)Fe(CN)_5]$. These teachings provide some guidance in choosing an optimal dopant for reducing reciprocity failure. However, there are still a large number of possible substituent and location combinations from which to choose.

SUMMARY OF THE INVENTION

In accordance with one embodiment, the invention is directed towards a silver halide emulsion comprising radiation sensitive silver halide grains exhibiting a face centered cubic crystal lattice structure containing a hexacoordination complex of an iridium ion in which at least half of the coordination sites in the hexacoordination complex are provided by halogen or pseudohalogen ligands, and at least one coordination site is provided by a ligand comprising a azole ring containing a chalcogen atom and a nitrogen atom, wherein the azole ring is substituted at the 5-position with a halide ion.

The invention provides emulsions containing with a preferred class of iridium dopants which are especially useful for improving reciprocity performance in silver halide emulsions with minimal or no impact on other aspects of photographic performance. These dopants have at least one azole ligand substituted at the 5-position with a halide ion and give a superior balance of reciprocity and other photographic properties compared to other iridium dopants exemplified in the prior art.

DETAILED DESCRIPTION OF THE INVENTION

The present invention has achieved modifications of photographic performance that can be specifically attributed to the presence during silver halide grain precipitation of iridium hexacoordination complexes containing one or more azole ligands which are substituted at the 5-position with a halide ion. The iridium complexes are compatible with the face centered cubic crystal structures of silver halide grains. As introduced, the iridium ion in the complex can be in a +4 valence state, or more preferably in a +3 valence state.

Further defining the iridium hexacoordination complexes are the ligands they contain, as the coordination complexes contain at least one organic ligand which comprises a 5-halo substituted heterocyclic azole ring containing a chalcogen atom and a nitrogen atom. Further, to achieve performance modification attributable to the presence of the 5-halo substituted azole organic ligand, at least half of the coordination sites provided by the iridium ions must be satisfied by halide or pseudohalide ligands (that is, ligands of types well known to be useful in photography) or a combination of halide and pseudohalide ligands.

A surprising discovery has been that the use of 5-halo substituted azole ligands in iridium hexacoordination complexes give a superior balance of reciprocity and other photographic properties compared to the use of other specific iridium dopant ligands exemplified in the prior art. The 5-halo substituted azole organic ligands employed in the invention may be represented by the following formula T:

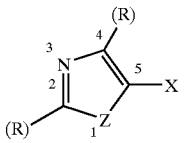

wherein Z represents a chalcogen atom (i.e., oxygen, sulfur, selenium or tellurium), X represents a fluoride, chloride, bromide, or iodide ion, and each R independently represents H or a substituent (i.e., the azole ring optionally may also be substituted at a 2- and/or the 4-position). Each R may be, e.g., any of a broad range of stable and synthetically convenient photographically acceptable substituents. Halide, pseudohalide, hydroxyl, nitro and organic substituents that are linked directly or through divalent oxygen, sulfur or nitrogen linkages are specifically contemplated, where the organic substituents can be simple or composite forms. Preferred T ligands include 5-halo thiazole and 5-halo oxazole. Especially preferred are 5-bromo thiazole and 5-chloro thiazole.

In preferred embodiments, optional substituent R groups of the 5-halo substituted azole organic ligands of formula T are limited such that the T ligands contain up to 24 (optimally up to 18) atoms of sufficient size to occupy silver or halide ion sites within the silver halide grain structure. Stated another way, these organic ligands preferably contain up to 24 (optimally up to 18) nonmetallic atoms. Since hydrogen atoms are sufficiently small to be accommodated interstitially within a silver halide face centered cubic crystal structure, the hydrogen content of the organic ligands poses no selection restriction. While these organic ligands can contain metallic ions, these also are readily sterically accommodated within the crystal lattice structure of silver halide, since metal ions are, in general, much smaller than nonmetallic ions of similar atomic number. For example, silver ion (atomic number 47) is much smaller than bromide ion (atomic number 35). In the overwhelming majority of instances these organic ligands consist of hydrogen and nonmetallic atoms selected from among carbon, nitrogen, oxygen, fluorine, sulfur, selenium, chlorine and bromine. The steric accommodation of iodide ions within silver bromide face centered cubic crystal lattice structures is well known in photography. Thus, even the heaviest non-metallic atoms, iodine and tellurium, can be included within the organic ligands, although their occurrence is preferably limited (e.g., up to 2 and optimally only 1) in any single organic ligand.

The requirement that at least one of the hexacoordination complex ligands be a 5-halo substituted azole organic ligand and that half of the ligands be halide or pseudohalide ligands permits up to two of the ligands in hexacoordination complexes to be chosen from among ligands other than 5-halo substituted azole organic ligands, halide and pseudohalide ligands. For example, nitrosyl (NO), thionitrosyl (NS), carbonyl (CO), oxo (O), aquo (HOH), and $NH_3$ ligands are all known to form coordination complexes that have been successfully incorporated in silver halide grain structures. These ligands are specifically contemplated for inclusion in the coordination complexes satisfying the requirements of the invention. Additionally, one or two of the other possible ligands may comprise other C—C, H—C or C—N—H organic ligands of the type described, e.g., in U.S. Pat. No. 5,360,712 referenced above, the disclosure of which is incorporated by reference herein in its entirety.

The iridium hexacoordination complex dopants employed in the invention may thus be represented by the general Formula I:

$$[IrX'_{6-a-b}T_aL_b]^n$$

where Ir represents iridium(III) or iridium (IV) ions (preferably iridium (III)), each X' is a halide or pseudohalide ion or any mixture of these, each T represents a 5-halo substituted azole organic ligand, subscript a is 1, 2 or 3, each L represents a ligand which is distinct from X' and T, subscript b is 0, 1 or 2, the sum of subscripts a and b is 1 to 3, and n represents the net charge of the coordination complex. In preferred embodiments, subscript a represents 1 or 2, more preferably 1, and subscript b represents 0 or 1. In a preferred combination of X' ligands, half or more are halide ligands, and more preferably half or more are bromide or chloride ligands. In an especially preferred form, all the X' ligands are halide ligands, and more preferably all are bromide or chloride ligands. In a further preferred combination of X' ligands, half or more are chloride ligands. When present, ligand L is preferably selected from nitrosyl (NO), thionitrosyl (NS), carbonyl (CO), oxo (O), aquo (HOH), and $NH_3$.

Superscript n represents the net charge on the coordination complex, and will depend upon the valence state of the iridium ion and the charge of the individual ligands. As Ir may be +3 or +4, each X' ligand will be −1, and each T and L ligand may be neutral or negative, the net charge n may be, e.g., 0, −1, −2, or −3. In preferred embodiments, where Ir represents iridium (III) and where T and L represent neutral ligands, n will represent 0, −1, or −2, depending upon the sum of a and b. In more preferred embodiments, wherein the sum of a and b is 1 or 2, n will represent −1 or −2. Where the Formula (I) dopants have a net negative charge, it is appreciated that they will be associated with a counter ion when added to the reaction vessel during grain precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated.

Specific examples of iridium coordination complex dopants which may be employed in accordance with the invention include: $[IrCl_5(5\text{-fluoro thiazole})]^{2-}$, $[IrCl_5(5\text{-chloro thiazole})]^{2-}$, $[IrCl_5(5\text{-bromo thiazole})]^{2-}$, $[IrCl_5(5\text{-iodo thiazole})]^{2-}$, $[IrCl_4(5\text{-fluoro thiazole})_2]^{1-}$, $[IrCl_4(5\text{-chloro thiazole})_2]^{1-}$, $[IrCl_4(5\text{-bromo thiazole})_2]^{1-}$, $[IrCl_4(5\text{-iodo thiazole})_2]^{1-}$, $[IrBr_5(5\text{-fluoro thiazole})]^{2-}$, $[IrBr_5(5\text{-chloro thiazole})]^{2-}$, $[IrBr_5(5\text{-bromo thiazole})]^{2-}$, and $[IrBr_5(5\text{-iodo thiazole})]^{2-}$.

One advantage of iridium dopants with organic ligands, including those described here, is their increased stability in aqueous solution compared to $[IrCl_6]^{3-}$. The low stability of $[IrCl_6]^{3-}$ is sometimes overcome by the use of $[IrCl_6]^{2-}$, stabilized in the higher IV oxidation state by the addition of $HNO_3$ to the dopant solution. $HNO_3$ is added to give dopant solutions which are 0.1 to 4 M in acid. Although this approach increases stability of the dopant solution, it limits utility since the acidified solution cannot be mixed with any solutions containing dopants with cyanide ligands. When multiple dopants are used in a single emulsion, it is sometimes useful to mix two or more together and to add them from a single source during emulsion precipitation. This eliminates the need for multiple dopant delivery systems in manufacturing and thus reduces manufacturing costs. Iridium dopants with organic ligands, such as the 5 -substituted azole ligands described above, can often be stabilized by raising the ionic strength of the dopant solution by addition of ions such as nitrate or perchlorate. Dopant solutions can also be stabilized by the addition of halide ion. In either case, it is not necessary to add acid to achieve optimal stability of the iridium dopant. Thus, stabilized solutions of iridium dopants with organic ligands dopants such as $K_2IrCl_5$ 5-Brtz can be safely mixed with other dopant solutions such as $K_2Ru(CN)_6$, and NaSCN. These mixed dopant solutions can then be safely added to the emulsion precipitation as a single solution.

In general any iridium hexacoordination complex containing the required balance of halo and/or pseudohalo ligands with one or more 5-halo substituted azole organic ligands as described above can be employed in the practice of the invention. This, of course, assumes that the coordination complex is structurally stable and exhibits at least very slight water solubility under silver halide precipitation conditions. Since silver halide precipitation is commonly practiced at temperatures ranging down to just above ambient (e.g., typically down to about 30° C.), thermal stability requirements are minimal. In view of the extremely low levels of dopants that have been shown to be useful in the art only extremely low levels of water solubility are required.

The iridium coordination complexes can be introduced during emulsion precipitation employing procedures well known in the art. The coordination complexes can be present in the dispersing medium present in the reaction vessel before grain nucleation. More typically the coordination complexes are introduced at least in part during precipitation through one of the halide ion or silver ion jets or through a separate jet. Another technique for coordination complex incorporation is to precipitate Lippmann emulsion grains in the presence of the coordination complex followed by ripening the doped Lippmann emulsion grains onto host grains. The dopants may be incorporated in core silver halide grains, and/or in epitaxial silver halide deposited onto core grains.

The iridium coordination complexes satisfying the requirements above can be present during silver halide emulsion precipitation in any conventional level known to be useful for iridium dopants. The complex can be located either uniformly or non-uniformly within the grains. Typically useful metal dopant ion concentrations, based on silver, range from $10^{-10}$ to $10^{-3}$ gram atom per mole of silver, with concentrations preferably ranging from $10^{-9}$ to $10^{-5}$ gram atom Ir/Ag mole, and more preferably from $10^{-8}$ to $10^{-6}$ gram atom Ir/Ag mole. A specific concentration selection is dependent upon the specific photographic effect sought. For complexes that contain a single metal dopant ion molar and gram atom concentrations are identical; for complexes containing two metal dopant ions gram atom concentrations are twice molar concentrations; etc. Following the accepted practice of the art, stated dopant concentrations are nominal concentrations—that is, they are based on the dopant and silver added to the reaction vessel prior to and during emulsion precipitation.

The iridium complexes identified above are useful in all photographic silver halide emulsion grains containing a face centered cubic crystal lattice structure. Any grain shapes may be employed, including, e.g., cubic, cubical, octahedral, and tabular grains. Silver halide emulsions contemplated include silver bromide, silver iodobromide, silver chlorobromide, silver iodochlorobromide, silver chloroiodobromide, silver chloride, silver bromochloride, silver iodochloride, silver bromoiodochloride, and silver iodobromochloride emulsions, where, in the mixed halides, the halide of higher concentration on a mole basis is named last. All of the above silver halides form a face centered cubic crystal lattice structure and are distinguishable on this basis from high (>90 mole %) iodide grains, that are rarely used for latent image formation. Conventional emulsion compositions and methods for their preparation are summarized in Research Disclosure, Item 308119, Section I, cited above and here incorporated by reference. Additional conventional photographic features which may be used in combination with doped emulsions in accordance with the invention are also disclosed in Item 308119, here incorporated by reference.

The above described iridium dopants have been found to be particularly useful in high bromide tabular grain color negative and photothermographic film emulsions, where such tabular grain emulsions preferably comprise at least 70 mole percent bromide, 0–30 mole percent iodide, and 0–30 mole percent chloride, based on total silver. More preferably, such tabular grain emulsions comprise at least 80 mole percent bromide, 0–15 mole percent chloride, and 0.25–15 mole percent iodide. In a particular embodiment, high bromide tabular silver halide photothermographic imaging emulsion are preferably doped with from 10–1000 (more preferably 100–500) molar ppb $[IrCl_5$ (5-Bromothiazole)$]^{2-}$, resulting in improved low intensity reciprocity in the 0.1–10 sec exposure region particularly useful in X-radiography, while avoiding a speed-loss associated with doping with iridium hexachloride.

The iridium dopants have also been found to be particularly useful in high chloride cubical gain color paper emulsions, where such cubical grain emulsions preferably comprise at least 70 mole percent chloride, 0–30 mole percent chloride, and 0–10 mole percent iodide. More preferably, such cubical grain emulsions comprise at least 90 mole percent chloride, 0–10 mole percent bromide, and 0–5 mole percent iodide. We also contemplate their use in cubical high bromide emulsions for graphic art films and paper, x-ray films, color negative and reversal films, and motion imaging print film. We further contemplate their use in high bromide tabular grain emulsions for color reversal films.

Preparation of Dopant Materials

Preparations are provided for example iridium coordination complexes for which no source citation is available. Additional complexes within the scope of the invention may be made by analogous procedures. All of the coordination complexes were characterized using 1H NMR spectroscopy, infrared spectroscopy, and uv-visible absorption spectroscopy. Thermogravimetric analysis (TGA) was also used.

For the synthesis of $K_2[IrCl_5$(5-bromothiazole)] or $K_2[IrCl_5$(5-chlorothiazole)], 2 grams of $K_3IrCl_6$ (3.8 mmoles) is added to 30 ml of water along with 1.25 grams of 5-bromothiazole (7.6 mmoles) (or 0.91 grams of 5-chlorothiazole) and heated with stirring at 65C for 1 hour. The solution is then cooled and added to 50 ml of stirred ethanol to precipitate the iridium complex. It is washed first with an ethanol-water solution (75 to 25 by volume) and then with ethanol and air dried. If the proton NMR spectrum of the isolated material in $D_2O$ indicates the presence of free 5-bromothiazole or 5-chlorothiazole, the solid is dissolved in a minimum amount of water and filtered through a paper filter into a stirred ethanol solution to precipitate a solid that does not contain entrained 5-bromothiazole or 5-chlorothiazole. The 5-bromothiazole was made by the procedure of Beyerman et al (H. C. Beyerman, P. H. Berben, and J. S. Bontekoe, Rec. Trav. Chim. 73, 325 (1954)). 5-chlorothiazole was made by substituting chlorine for bromine in the procedure described by Beyerman et al.

$Na[IrCl_4(5\text{-bromothiazole})_2].2H_2O$ was synthesized by reacting 1.8 grams of $Na_3[IrCl_6]$ (3.8 mmoles) with 2.5 grams of 5-bromothiazole (15.2 mmoles) in 30 ml of water at 90C for 1 hour. There is some decomposition of the 5-bromothiazole at this temperature. After 1 hour, the hot solution is quickly filtered through a paper filter to remove a tarry material present and washed with 5 ml of hot water. The filtrate is added to 50 ml of ethanol to precipitate the bis-substituted complex $Na[IrCl_4(5\text{-bromothiazole})_2].2H_2O$.

$K_2[IrBr_5(5\text{-bromothiazole})].2H_2O$ was synthesized by reacting 2 grams of $K_3[IrBr_6]$ (0.00254 mmoles) and 0.831 grams of 5-bromothiazole (0.0051 mmoles) in a stirred solution of 20 ml water and 20 ml of acetone at ambient temperature. After 2 days, the contents were added to 50 ml of stirred ethanol to precipitate a green material of $K_2[IrBr_5$ (5-bromothiazole)].$2H_2O$.

EXAMPLES

Example 1

Emulsions for Color Negative Film

The following Examples 1.1, 1.2, 1.3 and 1.4 demonstrate the usefulness, in color negative film emulsions, of iridium dopants with one or more 5-halo substituted thiazole ligands, where the substituent at the 5 position is bromide or chloride. At least three of the remaining of the ligands on the iridium dopant are made up of halide or pseudohalides. One or two of the remaining ligands can be an other type of ligand. The examples show that the 5-position on the thiazole ring is a preferred position compared to the 2 or the 4 position, and further that the dopants $[Cl_5Ir(pyz)IrCl_5]^{4-}$ (Ex. H-4 of U.S. Pat. No. 5,360,712) and $[IrCl_6]^{3-}$, previously disclosed as a dopant for color negative film emulsions, are inferior to iridium dopants with 5-substituted thiazole ligands for reducing HIRF and LIRF with minimal speed loss.

For Examples 1.1–1.4, we evaluate 2.5 $\mu$m×0.128 $\mu$m AgBrI tabular grain emulsions (3.7 mole percent iodide, based on total silver), doped with the shallow electron trapping dopant $[Ru(CN)_6]^{4-}$ and with the selenide source KSeCN, and additionally with an iridium dopant source (in the control emulsion, water was used in place of any Ir dopant solution). The emulsions were prepared according to the following Formula I:

A vessel equipped with a stirrer was charged with 4.5 liters of water containing 18.44 g of oxidized methionine lime-processed bone gelatin, 32.30 g sodium bromide, and an antifoamant at 40° C. It was then heated to 64.5° C. With stirring on, the addition 0.42 molar silver nitrate was then made, at a rate of 34.896 ml/min for 14 m 50 s. This was followed by the addition 33 ml of solution containing water and 16.50 g of NaBr. Subsequently, 104 milliliters of a solution containing water and 10.4 g of NaOH. The vessel was stirred for 5 minutes. This was followed by the addition of 59 ml of a solution containing water and 14.94 g of $HNO_3$. Next, a solution containing 2198 g water, 223.3 g oxidized methionine lime-processed bone gelatin, and an antifoamant, prewarmed to 64.5° C., was added to the stirred reaction vessel. Next, 3 molar NaBr solution was pumped in at a rate of 36.42 ml/min for 1 minute. During the next 44.5 minutes, the first growth stage took place wherein solutions of 3 molar $AgNO_3$ and 3 molar NaBr were added simultaneously. The AgNO3 solution started at a flow rate of 7.3 ml/min and increased quadratically for 44.5 minutes, according to the equation: flow rate=$0.0838t^2-0.3t+7.5157$ (t=time into growth stage 1). The NaBr solution started at a flow rate of 7.5 ml/min and increased quadratically for 44.5 minutes, according to the equation: flow rate= $0.0852t^2-0.2598t+7.6357$. During the next 1.5 minutes, the flow rate of $AgNO_3$ increased from 160.64 to 170.49 ml/min, the flow rate of NaBr increased from 164.99 to 175.85 ml/min, and a Dopant solution A was pumped in at a rate of 66.716 ml/min. Dopant solution A contained 37.8 g of a 0.00846 molar solution of $K_4Ru(CN)_6$, an iridium dopant of the type noted in Table I in an amount sufficient to achieve the dopant levels noted in Table I (no Ir dopant, 25, 325 or 1300 nanomoles Ir/mole of silver) and water sufficient to reach 100 mls of liquid. At this point, addition of $AgNO_3$, NaBr and dopant solution was halted and 1.26 mg of KSeCN in 37 ml of water was added to the vessel. Next, the 3 molar NaBr flow was started at a rate of 204.5 ml/min and run for 2 minutes and stopped. The vessel was then held with stirring for 1 minute. Following this, 1078.4 grams of a 0.50 molar suspension of silver iodide (Lippmann) was added to the vessel and the vessel was held with stirring for 2 minutes. The final growth section of the preparation, lasting for 13 minutes, then commenced with the continued addition of 3 molar $AgNO_3$ salt solution at a rate of 50 ml/min and the addition of 3 molar NaBr starting at a rate of 40.590 ml/min and increasing linearly to a rate of 50.212 ml/min at the end of 13 minutes. A total of 12.8 moles of silver iodobromide (3.7% bulk iodide) were formed. The resulting emulsion was washed via ultrafiltration. Lime-processed bone gelatin (269.3 g) was added along with a biocide and pH and pBr were adjusted to 6 and 3.37 respectively. Average emulsion grain size was 2.5 $\mu$m ECD×0.128 $\mu$m thickness.

Twenty different emulsions were prepared by varying the composition of Dopant solution A. These emulsions were similar except for the level and type of iridium dopant. The iridium dopant was varied according to the following Table 1:

TABLE 1

| | Emulsion number | Ir dopant (Na or K salt) | Ir dopant level |
|---|---|---|---|
| Control | 1-A | none | 0 |
| comparison | 1-B-1 | $[IrCl_6]^{3-}$ | 25 ppb |
| comparison | 1-B-2 | $[IrCl_6]^{3-}$ | 325 ppb |
| comparison | 1-C-1 | $[Cl_5Ir(pyz)IrCl_5]^{4-}$ | 25 ppb |
| comparison | 1-C-2 | $[Cl_5Ir(pyz)IrCl_5]^{4-}$ | 325 ppb |
| example | 1-D-1 | $[IrCl_5(5\text{-Cl tz})]^{2-}$ | 25 ppb |
| example | 1-D-2 | $[IrCl_5(5\text{-Cl tz})]^{2-}$ | 325 ppb |
| example | 1-E-1 | $[IrCl_5(5\text{-Br tz})]^{2-}$ | 25 ppb |
| example | 1-E-2 | $[IrCl_5(5\text{-Br tz})]^{2-}$ | 325 ppb |
| comparison | 1-F-1 | $[IrCl_5(5\text{-Me tz})]^{2-}$ | 25 ppb |
| comparison | 1-F-2 | $[IrCl_5(5\text{-Me tz})]^{2-}$ | 325 ppb |
| comparison | 1-G-2 | $[IrCl_4(2\text{-Br tz})_2]^{1-}$ | 325 ppb |
| example | 1-H-2 | $[IrCl_4(5\text{-Br tz})_2]^{1-}$ | 325 ppb |
| example | 1-H-3 | $[IrCl_4(5\text{-Br tz})_2]^{1-}$ | 1300 ppb |
| comparison | 1-I-2 | $[IrCl_5(4,5\text{-diMe tz})]^{2-}$ | 325 ppb |

TABLE 1-continued

| | Emulsion number | Ir dopant (Na or K salt) | Ir dopant level |
|---|---|---|---|
| comparison | 1-J-2 | $[IrCl_5(4\text{-Me tz})]^{2-}$ | 325 ppb |
| comparison | 1-K-2 | $[IrCl_5(2\text{-Br tz})]^{2-}$ | 325 ppb |
| comparison | 1-L-2 | $[IrCl_5(tz)]^{2-}$ | 325 ppb |
| example | 1-M-2 | $[IrBr_5(5\text{-Br tz})]^{2-}$ | 325 ppb |
| comparison | 1-N-2 | $[IrBr_5(5\text{-Me tz})]^{2-}$ | 325 ppb |

All emulsions were optimally sensitized by melting with stirring at 40° C., adding 140 mg/Ag mole KSCN, 10 mg/Ag mole the tetrafluoroborate salt of 3-(3-((methylsulfonyl) amino)-3-oxopropyl)-benzothiazolium, and optimal levels of a mixture of red sensitizing dyes A and B (2.1:1 ratio) (below), the sodium salt of N-[(dimethylamino)thioxomethyl]-N-methyl-Glycine, and the tripotassium salt of bis[2-[[[3-[4,5-dihydro-5-(thioxo-kS)-1H-tetrazol-1-yl]phenyl] amino]carbonyl]benzenesulfonato(2−)]-aurate(3−). After the addition of these reagents, the emulsions were held for 9' at 62.5, cooled to 40° C., and 1 g/Ag mole of the sodium salt of 5-methyl-(1,2,4)Triazolo(1,5-a)pyrimidin-7-ol.

Spectral Sensitizing Dye A

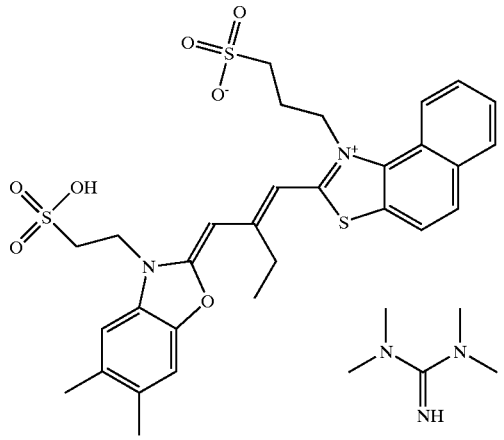

Spectral Sensitizing Dye B

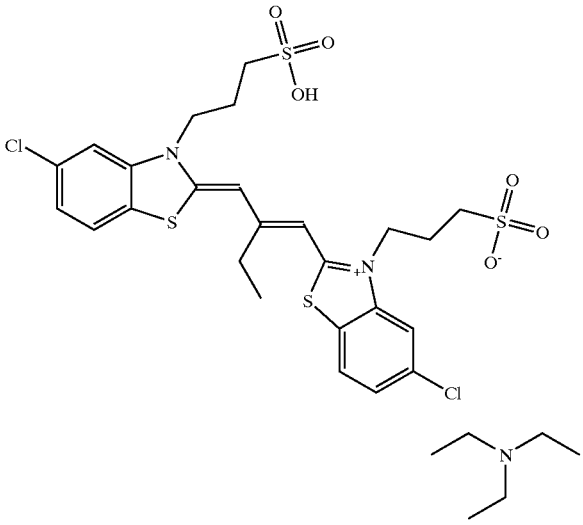

The sensitized emulsions were then coated as follows: The red sensitized emulsion portions were combined with gelatin and coated with a coupler melt made up to provide a coating laydown of 120 mg/ft$^2$ of red dye-forming coupler A, 75 mg/ft$^2$ of silver, and 300 mg/ft$^2$ of gelatin on a cellulose acetate photographic support. The coupler-containing emulsion layer was overcoated with 250 mg/ft$^2$ gelatin and 1,1'-(methylenebis(sulfonyl))bis-ethene hardener at 1.8% by weight, based on total gelatin. The support had been previously coated with a carbon black anti-halation layer and a 450 mg/ft$^2$ gelatin pad.

Coupler A

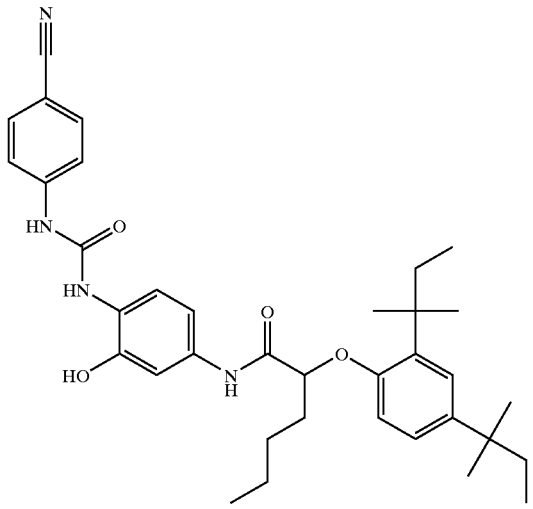

The coated photographic film samples were exposed through a step tablet and a W23A filter and processed for 2.5 minutes in Kodak Flexicolor C-41™ process. Density measurements were made and plotted versus log exposure. Reciprocity measurements were made using a series of matched (total energy) exposures at 0.01 second and at 0.0001 sec and 1 s. The developed density in the unexposed portion of the coating was measured and recorded as the minimum density or dmin. The speed required to reach an optical density of 0.15 above dmin was measured, and recorded as 0.15 speed (0.15 spd). We measured the maximum contrast of the photographic curve for each emulsion.

Example 1.1

Here we compare photographic performance of those AgBrI tabular grain emulsions prepared as above and containing 25 ppb of an iridium dopant. In the control emulsion, water was used in place of any Ir dopant solution. We report the delta dmin [dmin(doped)−dmin(control)], the delta 0.15 spd [0.15 spd(doped)−0.15 spd(control)], % delta gamma (the effect of the dopant on maximum contrast), HIRF and LIRF in Table 1.1. The HIRF parameter was obtained for each emulsion by subtracting the 0.15 spd obtained for an exposure delivered over a time of 0.01s from the 0.15 spd obtained for an exposure of identical magnitude (same number of photons) delivered over a time of 0.0001s. A negative number is indicative of HIRF. Ideally, the HIRF parameter is 0. The LIRF parameter was obtained for each emulsion by subtracting the 0.15 spd obtained for an exposure delivered over a time of 0.01s from the 0.15 spd obtained for an exposure of identical magnitude (same number of photons) delivered over a time of 1s. A negative number is indicative of LIRF. Ideally, the LIRF parameter is 0.

TABLE 1.1

| Emulsion | Ir dopant | delta dmin | delta .15 spd | % delta gamma | HIRF (.0001 s) | LIRF (1 s) |
|---|---|---|---|---|---|---|
| 1-A (Control) | none | 0 | 0 | 0 | −5.2 | −6.3 |
| 1-D-1 (example) | $[IrCl_5(5\text{-Cl tz})]^{2-}$ | −0.01 | 3 | −1 | −2.5 | −5 |
| 1-E-1 (example) | $[IrCl_5(5\text{-Br tz})]^{2-}$ | −0.01 | 2 | −3 | −2.9 | −7.3 |
| 1-F-1 (comp) | $[IrCl_5(5\text{-Me tz})]^{2-}$ | −0.01 | 0 | −5 | −3.7 | −7.5 |
| 1-B-1 (comp) | $[IrCl_6]^{3-}$ | −0.01 | −18 | −12 | −4.8 | −2.6 |
| 1-C-1 (comp) | $[Cl_5Ir(pyz)IrCl_5]^{4-}$ | 0.08 | −9 | −2 | −0.9 | −4.5 |

Only the $[Cl_5IrpyzIrCl_5]^{4-}$ dopant had any significant effect on dmin. The emulsions containing $[IrCl_5(5\text{-Cl thiazole})]^{2-}$ or $[IrCl_5(5\text{-Br thiazole})]^{2-}$ showed speed gains. The emulsion doped with $[IrCl_5(5\text{-methyl thiazole})]^{2-}$ showed no change in speed. The emulsions doped with $[IrCl_6]^{3-}$ or $[Cl_5Ir(pyz)IrCl_5]^{4-}$ showed speed losses.

The emulsions containing$[IrCl_5(5\text{-chloro thiazole})]^{2-}$ or $[IrCl_5(5\text{-bromo thiazole})]^{2-}$ had reduced HIRF compared to the undoped control or compared to the emulsions containing $[IrCl_5(5\text{-methyl thiazole})]^{2-}$ or the $[IrCl_6]^{3-}$. The $[Cl_5Ir(pyz)IrCl_5]^{4-}$ doped emulsion had the best HIRF parameter although this was obtained at the cost of a considerable amount of speed.

The emulsion containing $[IrCl_5(5\text{-Cl thiazole})]^{2-}$ had reduced LIRF compared to the undoped control. The emulsions containing $[IrCl_5(5\text{-Br thiazole})]^{2-}$ or $[IrCl_5(5\text{-Me thiazole})]^{2-}$ had worse LIRF compared to control. The $[IrCl_6]^{3-}$ and $[Cl_5Ir(pyz)IrCl_5]^{4-}$ doped emulsions had the best LIRF parameters although these were obtained at the cost of a considerable amount of speed.

Thus, the emulsions containing dopants $[IrCl_5(5\text{-Cl thiazole})]^{2-}$ or $[IrCl_5(5\text{-Br thiazole})]^{2-}$ are faster and have reduced HIRF compared to the emulsion containing the dopant $[IrCl_5(5\text{-methylthiazole})]^{2-}$ or compared to the undoped emulsion. The emulsion containing $[IrCl_5(5\text{-Cl thiazole})]^{2-}$ had reduced LIRF compared to the undoped control. These reciprocity improvements were obtained with no effect on dmin and with a concomitant speed increase for "normal" exposure times. These dopant features are particularly useful for a high speed color negative film.

Example 1.2

Here we examine the photographic performance of the AgBrI tabular grain emulsions, doped with $[Ru(CN)_6]^{4-}$ and KSeCN, and additionally with $[IrCl_4(2\text{-Br thiazole})_2]^{1-}$ or $[IrCl_4(5\text{-Br thiazole})_2]^{1-}$, and a control emulsion where water was used in place of any Ir dopant solution. The emulsions were sensitized with red sensitizing dye, sulfur and gold sensitized, and coated and tested as described above. The speed required to reach an optical density of 1.0 above dmin was measured, and recorded as 1.0 speed (1.0 spd). The contrast at a density of 1.0 above dmin was also measured for all emulsions. We report the delta 0.15 spd [0.15 spd(doped)−0.15 spd(control)], the delta 1.0 spd difference [1.0 spd(doped)−1.0 spd(control)], % delta contrast, HIRF and LIRF (as measured in Example 1.1) in Table 1.2. None of the dopants had a significant effect on dmin.

TABLE 1.2

| Emulsion | Ir level (ppb) | Description | Delta 0.15 spd | Delta 1.0 spd | % Delta Contrast | HIRF | LIRF |
|---|---|---|---|---|---|---|---|
| 1-A (control) | 0 | — | 0 | 0 | 0 | −5 | −8 |
| 1-G-2 (comp) | 325 | $[IrCl_4(2\text{-Brtz})_2]^{1-}$ | −19 | −18 | 8 | −3 | −21 |
| 1-H-2 (example) | 325 | $[IrCl_4(5\text{-Brtz})_2]^{1-}$ | −0.5 | 2 | −2 | −5 | −7 |
| 1-H-3 (example) | 1300 | $[IrCl_4(5\text{-Brtz})_2]^{1-}$ | −1 | 10 | 9 | −8 | −5 |

The emulsion containing $[IrCl_4(2\text{-Br thiazole})_2]^{1-}$ showed large toe speed (0.15 spd) and shoulder speed (1.0 spd) losses. The latter was smaller than the former, so this emulsion showed a large overall increase in contrast. The $[IrCl_4(2\text{-Br thiazole})_2]^{1-}$ dopant caused a minimal improvement in HIRF and a degradation in LIRF. Surprisingly, replacing the (2-Br thiazole) ligands with (5-Br thiazole) improved the performance of the associated doped emulsions. The emulsion containing the 325 ppb of dopant with two (5-Br thiazole) ligands showed only small changes in photographic parameters compared to the undoped emulsion. However, when the dopant level was raised to 1300 ppb of dopant, shoulder speed and contrast increased, along with a minimal change in toe speed, degradation of HIRF and an improvement in LIRF reduction. The dopant level of 1300 ppb corresponds to about 17,000 Ir ions per grain. It is surprising to be able to dope with such a high level of iridium dopant with no degradation in speed. Thus, beneficial photographic properties, such as higher shoulder speed, may be achieved with no significant degradation of other parameters, i.e., toe speed, where the 2-Br thiazole ligands are substituted with 5-Br thiazole ligands.

Example 1.3

Here we examine the photographic performance of the AgBrI tabular grain emulsions, doped with $[Ru(CN)_6]^{4-}$ and KSeCN, and additionally with 325 ppb of $[IrCl_5(5\text{-Cl thiazole})]^{2-}$ or $[IrCl_5(5\text{-Br thiazole})]^{2-}$. For comparison, we examined emulsions doped with either 325 ppb of $[IrCl_5(5\text{-methyl thiazole})]^{2-}$, $[IrCl_5(\text{thiazole})]^{2-}$, $[IrCl_5(2\text{-bromo thiazole})]^{2-}$, $[IrCl_5(4\text{-methyl thiazole})]^{2-}$, $[IrCl_5(4,5\text{-dimethyl thiazole})]^{2-}$, $[IrCl_6]^{3-}$ or $[Cl_5IrpyzIrCl_5]^{4-}$, in place of $[IrCl_5(5\text{-halo thiazole})]^{2-}$. In the control emulsion, water was used in place of any Ir dopant solution. The emulsions were sensitized with a red sensitizing dye, sulfur and gold sensitized, and coated and tested as described above. Delta dmin, delta 0.15 spd, % delta gamma, HIRF and LIRF (as defined above) are reported in Table 1.3.

TABLE 1.3

| Emulsion | Ir dopant | delta dmin | delta .15 spd | % delta gamma | HIRF | LIRF |
|---|---|---|---|---|---|---|
| 1-A (comp) | none | 0 | 0 | 0 | −5 | −6.6 |
| 1-E-2 (example) | $[IrCl_5(5\text{-Br tz})]^{2-}$ | 0.03 | −2 | 0 | −2.2 | −1.5 |
| 1-D-2 (example) | $[IrCl_5(5\text{-Cl tz})]^{2-}$ | 0.02 | −2 | −5 | −1.9 | −1.4 |
| 1-F-2 (comp) | $[IrCl_5(5\text{-Me tz})]^{2-}$ | 0.08 | −3 | 0 | −3.4 | −5.4 |
| 1-L-2 (comp) | $[IrCl_5(\text{tz})]^{2-}$ | 0.07 | −6 | −1 | −2.1 | −4.1 |
| 1-I-2 (comp) | $[IrCl_5(4,5\text{-diMe tz})]^{2-}$ | 0.01 | −10 | 0 | −2.6 | −4.9 |
| 1-J-2 (comp) | $[IrCl_5(4\text{-Me tz})]^{2-}$ | 0.02 | −18 | 6 | −0.7 | −8.7 |
| 1-K-2 (comp) | $[IrCl_5(2\text{-Br tz})]^{2-}$ | 0.02 | −22 | 7 | −2.2 | −23.2 |
| 1-B-2 (comp) | $[IrCl_6]^{3-}$ | 0.02 | −28 | −16 | −1.7 | −3 |
| 1-C-2 (comp) | $[Cl_5Ir(pyz)IrCl_5]^{4-}$ | −0.01 | −37 | −23 | −1.2 | −0.8 |

Only the $[IrCl_5(5\text{-Me tz})]^{2-}$ and $[IrCl_5(\text{tz})]^{2-}$ had any significant effect on dmin (increased dmin). The emulsions containing $[IrCl_5(5\text{-Cl thiazole})]^{2-}$ or $[IrCl_5(5\text{-Br thiazole})]^{2-}$ showed the lowest speed loses on doping and the greatest reduction in LIRF of any of the emulsions listed in Table 1.3. The emulsions containing $[IrCl_5(5\text{-Cl thiazole})]^{2-}$ or $[IrCl_5(5\text{-Br thiazole})]^{2-}$ also reduced HIRF without large (−10 to −37) speed losses seen for $[IrCl_5(4,5\text{-dimethyl thiazole})]^{2-}$, $[IrCl_5(4\text{-methyl thiazole})]^{2-}$, $[IrCl_5(2\text{-bromo thiazole})]^{2-}$, $[IrCl_6]^{3-}$ or $[Cl_5Ir(pyz)IrCl_5]^{4-}$. The emulsions containing $[IrCl_5(5\text{-Cl thiazole})]^{2-}$ or $[IrCl_5(5\text{-Br thiazole})]^{2-}$ reduced HIRF and LIRF without the increase in dmin seen for emulsions containing $[IrCl_5(\text{thiazole})]^{2-}$ or $[Cl_5(5\text{-Me thiazole})]^{2-}$. Surprisingly, substituting a (5-bromo thiazole) ligand for a (2-bromo thiazole) ligand on the $[IrCl_5(2\text{-bromo thiazole})]^{2-}$ dopant greatly improved the performance of the associated emulsion doped with $[IrCl_5(5\text{-Br tz})]^{2-}$. Speed loss was reduced from 22 CR to 2 CR while maintaining a small reduction in HIRF and greatly improving LIRF.

Example 1.4

Here we examine the photographic performance of the AgBrI tabular grain emulsions, doped with $[Ru(CN)_6]^{4-}$ and KSeCN, and additionally with 325 ppb of $[IrBr_5(5\text{-Br thiazole})]^{2-}$ or $[IrCl_5(5\text{-Br thiazole})]^{2-}$. For comparison, we examined emulsions doped with either 325 ppb of $[IrCl_5(5\text{-methyl thiazole})]^{2-}$, $[IrBr_5(5\text{-methyl thiazole})]^{2-}$, $[IrCl_5(2\text{-bromo thiazole})]^{2-}$, $[IrCl_6]^{3-}$ or $[Cl_5IrpyzIrCl_5]^{4-}$, in place of $[IrX_5(5\text{-Br thiazole})]^{2-}$. In the control emulsion, water was used in place of any Ir dopant solution.

The emulsions were sensitized with a red sensitizing dye, sulfur and gold sensitized, and coated and tested similarly as described above. Delta dmin, delta 0.15 spd, % delta gamma, and HIRF (as defined above) are reported in Table 1.4. LIRF values reported in Table 1.4 were obtained for each emulsion by subtracting the 0.15 spd obtained for an exposure delivered over a time of 0.01s from the 0.15 spd obtained for an exposure of identical magnitude (same number of photons) delivered over a time of 10s.

TABLE 1.4

| Emulsion | Ir dopant | delta dmin | delta .15 spd | % delta gamma | HIRF (.0001 s) | LIRF (10 s) |
|---|---|---|---|---|---|---|
| 1-A (comp) | NONE | 0 | 0 | 0 | −5 | −23.8 |
| 1-E-2 (example) | $[IrCl_5(5\text{-Br tz})]^{2-}$ | 0.03 | −2 | 0 | −2.2 | −14 |
| 1-M-2 (example) | $[IrBr_5(5\text{-Br tz})]^{2-}$ | 0.03 | −34.65 | −12 | −1.7 | 0.7 |
| 1-N-2 (comp) | $[IrBr_5(5\text{-Me tz})]^{2-}$ | 0.03 | −21.7 | −12 | −3.3 | −2.4 |
| 1-F-2 (comp) | $[IrCl_5(5\text{-Me tz})]^{2-}$ | 0.08 | −3 | 0 | −3.4 | −20 |
| 1-K-2 (comp) | $[IrCl_5(2\text{-Br tz})]^{2-}$ | 0.02 | −22 | 7 | −2.2 | −50.5 |
| 1-B-2 (comp) | $[IrCl_6]^{3-}$ | 0.02 | −28 | −16 | −1.7 | −3.3 |
| 1-C-2 (comp) | $[Cl_5Ir(pyz)IrCl_5]^{4-}$ | −0.01 | −37 | −23 | −1.2 | −4.1 |

Substituting bromide ligands for chloride ligands on the $[IrCl_5(5\text{-bromo thiazole})]^{2-}$ and the $[IrCl_5(5\text{-methyl thiazole})]^{2-}$ dopants caused a large speed loss and greatly improved LIRF in both cases. These dopants also reduced LIRF more than the $[Cl_5Ir(pyz)IrCl_5]^{4-}$ and the $[IrCl_6]^{3-}$ dopants. The $[IrBr_5(5\text{-Br tz})]^{2-}$ dopant reduced LIRF more than the $[IrBr_5(5\text{-Me tz})]^{2-}$ dopant. The iridium dopants with bromide ligands and one 5-substituted thiazole ligand would be useful for applications where greatly reduced LIRF was required. They would be useful in the slow emulsions of color negative film.

Results similar to those described in Examples 1.1–1.4 were obtained with similarly-doped AgBrI tabular grain emulsions sensitized with blue absorbing dyes or green absorbing dyes. The effects produced by example iridium dopant were independent of grain size, although the optimum dopant level was roughly inversely proportional to grain diameter. The example iridium dopants could be placed anywhere in the emulsion grain, including in epitaxial deposits and worked equally well in the presence or absence of selenide or SET dopants such as $K_4Ru(CN)_6$. The example dopants could be combined with other iridium dopants to fine-tune speed and reciprocity responses.

The ability to mix stable, pH neutral, solutions of the example Ir dopants with solutions of cyanide-containing dopants such as $K_4Ru(CN)_6$ allows the use of both iridium and the $K_4Ru(CN)_6$ dopant in emulsion preparation facilities where the number of solution delivery lines is limited and where installation of additional solution delivery lines would be cost prohibitive. A tabular emulsion, similar to that described above but with a size of 1.57×0.13 um, has been produced for use as a red-sensitized emulsion in a multilayer color negative film. This emulsion has been doped similarly as above with 0.2 mg/Ag mole of KSeCN, and with an acidified dopant solution containing sufficient $K_2IrCl_6$ to supply 25 ppb of $[IrCl_6]^{3-}$/Ag mole to the emulsion grain. This level of $[IrCl_6]^{3-}$ is sufficient to reduce HIRF to a small density loss (0.02) at the density point half way between dmin and dmax for matched exposures carried out over times of 0.0001 s versus 0.01 s. It is also low enough to maintain acceptable overall photographic sensitivity of the doped emulsion. When the acidified solution is replaced with a stable solution containing sufficient $K_4Ru(CN)_6$ to supply 25 ppm $[Ru(CN)_6]^{4-}$/Ag mole and 420 ppb $[IrCl_5$ (5-Br tz)$]^{2-}$/Ag mole to the emulsion grain, the density loss at the density point half way between dmin and dmax for matched exposures carried out at 0.0001 s and at 0.01 s is reduced by a factor of 4 and the overall sensitivity of the emulsion at 0.15 density increased by 10 relative log speed units. Thus, the use of the example dopant $[IrCl_5(5\text{-Br tz})]^{2-}$ enables a new doping approach which improved both reciprocity and emulsion sensitivity.

Example 2

Emulsions for Color Paper

The following examples 2.1–2.6 demonstrate the usefulness, in high chloride color paper emulsions, of iridium dopants comprising a 5-halo substituted thiazole ligand in accordance with the invention. The examples show that the 5 position on the thiazole ring is a preferred position for halo substituents, compared to the 2 position, and that 5-halo substituents are preferable to 5-methyl substituents.

Example 2.1

A Magenta Paper Example

A reaction vessel contained 6.92 L of a solution that was 3.8% in regular gelatin and contained 1.71 g of a Pluronic antifoam agent. To this stirred solution at 46° C. 83.5 mL of 3.0 M NaCl was dumped, and soon after 28.3 mL of dithiaoctanediol solution was poured into the reactor. A half minute after addition of dithiaoctanediol solution, 104.5 mL of a 2.8 M $AgNO_3$ solution and 107.5 mL of 3.0 M NaCl were added simultaneously at 209 mL/min for 0.5 minute. The vAg set point was chosen equal to that observed in the reactor at this time. Then the 2.8 M silver nitrate solution and the 3.0 M sodium chloride solution were added simultaneously with a constant flow at 209 mL/min over 20.75 minutes. The resulting silver chloride emulsion had a cubic shape that was 0.38 $\mu$m in edgelength. The emulsion was then washed using an ultrafiltration unit, and its final pH and pCl were adjusted to 5.6 and 1.8, respectively.

Iridium doped emulsions were precipitated exactly as above, except that $K_2[IrCl_5$ (5-Bromo thiazole)], $K_2[IrCl_5$ (5-Methyl-Thiazole)] or $K_2[IrCl_5$ (2-Bromo thiazole)] were added during precipitation during to 90 to 95% of grain formation at the levels specified in Table 2.1.

A portion of each emulsion was optimally sensitized by the addition of p-glutaramidophenyl disulfide (GDPD) followed by the optimum amount of a colloidal suspension of aurous sulfide. The emulsion was then heated to 55° C. and held at this temperature for 35 minutes with subsequent addition of Lippmann bromide followed by addition of green Spectral Sensitizing dye C, and followed by addition 1-(3-acetamidophenyl)-5-mercaptotetrazole. Then the emulsion was cooled to 40° C.

Spectral Sensitizing Dye C

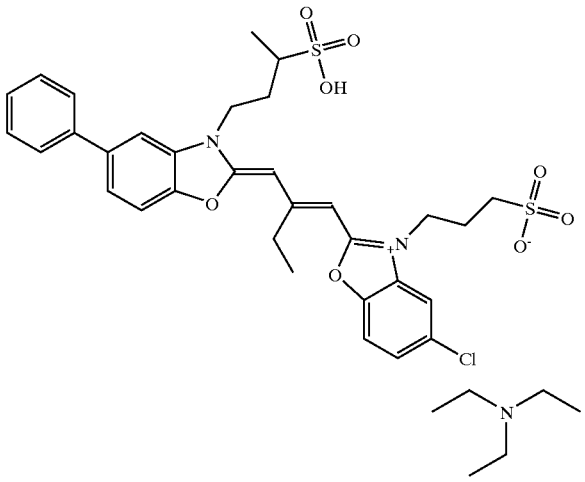

Just prior to coating on resin coated paper support magenta-sensitized emulsions were dual-mixed with magenta dye forming coupler B:

Coupler B

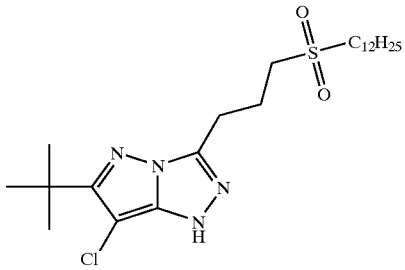

The magenta sensitized emulsions were coated at 108 mg silver per square meter on resign-coated paper support. The coatings were overcoated with gelatin layer and the entire coating was hardener with bis(vinlsulfonymethyl)ether.

Coatings were exposed through a step wedge with 3000 K tungsten source for exposures of 0.0001 s, 0.1 s or 1 s. The total energy of each exposure was kept at a constant level. All coatings were processed in Kodak™ Ektacolor RA-4. Relative speeds were reported at density level equal to 0.80. TOE density was measured as the density at density level equal 0.80 minus 0.40 loge, while SHOULDER density was measured as the density at density level equal to 0.80 plus 0.40 logE. Delta speed HIRF is the difference between speed at 0.80 density from an exposure at 0.0001 second and that from an exposure at 1 second (closer to 0 is better). Delta toe HIRF is the difference between toe density from an exposure at 0.0001 second and that from an exposure at 1 second (closer to 0 is better). Delta shoulder HIRF is the difference between shoulder density from an exposure at 0.0001 second and that from an exposure at 1 second (closer to 0 is better).

TABLE 2.1

| Dopant | | Level | Speed at 0.1 sec | delta speed HIRF | delta shoulder HIRF | delta toe HIRF |
|---|---|---|---|---|---|---|
| None | control | 0 | 208 | −51 | −0.374 | 0.132 |
| $[IrCl_5(5\text{-Me tz})]^{2-}$ | comparison | 150 ppb | 211 | −17 | −0.285 | 0.083 |
| $[IrCl_5(5\text{-Br tz})]^{2-}$ | example | 150 ppb | 213 | −7 | −0.273 | 0.043 |
| $[IrCl_5(5\text{-Me tz})]^{2-}$ | comparison | 300 ppb | 216 | −3.4 | −0.219 | 0.057 |
| $[IrCl_5(5\text{-Br tz})]^{2-}$ | example | 300 ppb | 211 | 0.7 | −0.115 | 0.032 |
| $[IrCl_5(2\text{-Br tz})]^{2-}$ | comparison | 300 ppb | 206 | −23 | −0.396 | 0.117 |
| $[IrCl_5(5\text{-Me tz})]^{2-}$ | comparison | 450 ppb | 216 | −1.5 | −0.186 | 0.038 |
| $[IrCl_5(5\text{-Br tz})]^{2-}$ | example | 450 ppb | 210 | 2 | −0.039 | 0.019 |

The results show that the dopant $[IrCl_5(5\text{-Br tz})]^{2-}$ is more effective in reducing HIRF, over a broad range of dopant levels, than $[IrCl_5(5\text{-Me tz})]^{2-}$ or $[IrCl_5(2\text{-Br tz})]^{2-}$. The $[IrCl_5(5\text{-Br tz})]^{2-}$ dopant reduces HIRF with improved 0.1 sec speed relative to the undoped control and with only slightly lower 0.1 sec speeds compared to $[IrCl_5(5\text{-Me tz})]^{2-}$.

Example 2.2

A Cyan Paper Example

A reaction vessel contained 6.92 L of a solution that was 3.8% in regular gelatin and contained 1.71 g of a Pluronic antifoam agent. To this stirred solution at 46° C. 83.5 mL of 3.0 M NaCl was dumped, and soon after 28.3 mL of dithiaoctanediol solution was poured into the reactor. A half minute after addition of dithiaoctanediol solution, 104.5 mL of a 2.8 M $AgNO_3$ solution and 107.5 mL of 3.0 M NaCl were added simultaneously at 209 mL/min for 0.5 minute. The vAg set point was chosen equal to that observed in the reactor at this time. Then the 2.8 M silver nitrate solution and the 3.0 M sodium chloride solution were added simultaneously with a constant flow at 209 mL/min over 20.75 minutes. During precipitation 16.54 milligrams per silver mole of $K_4Ru(CN)_6$ was added during to 80 to 85% of grain formation and 1.20 milligrams per silver mole of $K_2IrCl_5$ (5-Methyl-Thiazole) was added during to 90 to 95% of grain formation. The resulting silver chloride emulsion had a cubic shape that was 0.38 $\mu$m in edge length. The emulsion was then washed using an ultrafiltration unit, and its final pH and pCl were adjusted to 5.6 and 1.8, respectively.

Iridium doped emulsions were precipitated exactly as above, except that 1.34 milligrams per silver mole of $K_2IrCl_5$ (5-Bromo thiazole) was added instead of $K_2IrCl_5$ (5-Methyl-Thiazole) during precipitation during to 90 to 95% of grain formation.

A portion of each emulsion was optimally sensitized by the addition of p-glutaramidophenyl disulfide (GDPD) followed by the optimum amount of hypo followed by addition of gold(I). The emulsion was then heated to 65° C. and held at this temperature for 30 minutes with subsequent addition of 1-(3-acetamidophenyl)-5-mercaptotetrazole followed by addition of Lippmann bromide and followed by addition of red Spectral Sensitizing dye D. Then the emulsion was cooled to 40° C.

Spectral Sensitizing Dye D

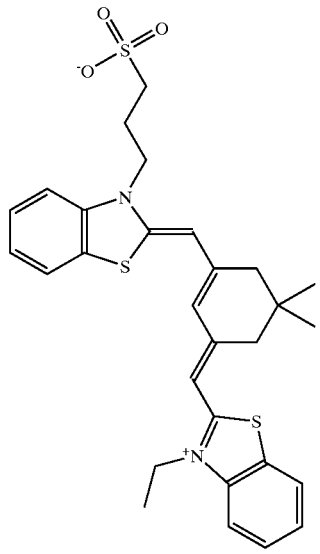

Just prior to coating on resin coated paper support cyan-sensitized emulsions were dual-mixed with cyan dye forming coupler C:

Coupler C

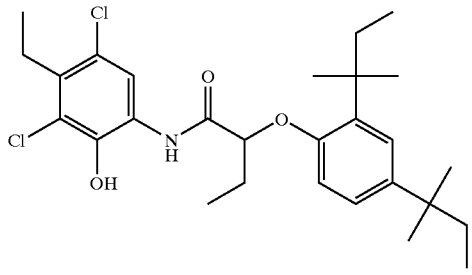

The cyan sensitized emulsions were coated at 194 mg silver per square meter on resign-coated paper support. The coatings were overcoated with gelatin layer and the entire coating was hardener with bis(vinlsulfonymethyl)ether.

Coatings were exposed through a step wedge with 3000 K tungsten source at the following exposure times: 0.0001, 0.001, 0.01, 1 and 10 seconds. The total energy of each exposure was kept at a constant level. Speed is reported as relative log speed at specified level above the minimum density as presented in the following Examples. In relative log speed units a speed difference of 30, for example, is a difference of 0.30 log E, where E is exposure in lux-seconds. All coatings were processed in Kodak™ Ektacolor RA-4. Relative speeds were reported at density level equal to 0.80. TOE were reported as the density at density level equal 0.80 minus 0.30 logE, while SHOULDER were reported as the density at density level equal to 0.80 plus 0.30 logE. Delta speed HIRF is the difference between speed at 0.80 density from an exposure at 0.0001 second and that from an exposure at 0.01 second (closer to 0 is better). Delta toe HIRF is the difference between toe density from an exposure at 0.0001 second and that from an exposure at 0.01 second (closer to 0 is better). Delta shoulder HIRF is the difference between shoulder density from an exposure at 0.0001 second and that from an exposure at 0.01 second (closer to 0 is better). Delta speed LIRF is the difference between speed at 0.80 density from an exposure at 0.01 second and that from an exposure at 10 second (closer to 0 is better). Delta toe LIRF is the difference between toe density from an exposure at 0.01 second and that from an exposure at 10 second (closer to 0 is better). Delta shoulder LIRF is the difference between shoulder density from an exposure at 0.01 second and that from an exposure at 10 second (closer to 0 is better). The "Digital Reciprocity" was defined as the difference between optical shoulder and digital shoulder (close to 0 is better). Sensitometric data are summarized in Table 2.2

TABLE 2.2

| Dopant | Level | Speed at 0.1 sec | Delta Speed HIRF | Delta Shoulder HIRF | Delta Speed LIRF | Delta Shoulder LIRF | (Optical-Digital) Shoulder |
|---|---|---|---|---|---|---|---|
| $[IrCl_5(5\text{-Me tz})]^{2-}$ (comp) | 2059 ppb | 137 | −6.6 | −0.271 | −9.0 | 0.201 | 0.140 |
| $[IrCl_5(5\text{-Br tz})]^{2-}$ (example) | 2059 ppb | 134 | −5.8 | −0.258 | 0.1 | 0.012 | 0.028 |

It is evident from Table 2.2 that the presence of $[IrCl_5(5\text{-Br thiazole})]^{2-}$ has slightly lower emulsion sensitivity compared to $[IrCl_5(5\text{-Me thiazole})]^{2-}$. The HIRF improvements in both cases are about the same; however, the presence of $[IrCl_5(5\text{-Br thiazole})]^{2-}$ controls LIRF (out to 10 sec) much better than $[IrCl_5(5\text{-Me thiazole})]^{2-}$. Coatings were also tested for laser Latent Image Keeping (LIK) stability from 20 sec to 2 minutes, 2 hours and 24 hours. Both emulsions produce similar laser LIK instability.

Example 2.3

Yellow Paper Example

To a reactor incorporating a stirring device as disclosed in *Research Disclosure*, Item 38213, and containing 8.921 grams of distilled water, 25 milligrams of p-glutaramidophenyldisulfide and 250 grams of bone gelatin, were added 294 grams of 3.8 M sodium chloride salt solution such that the mixture was maintained at a pCl of about 1.05 at approximately 68° C. To this were added 1.9 grams of 1,8-dihydroxy-3,6-dithiaoctane approximately 30 seconds before commencing introduction of silver and chloride salt solutions. Aqueous solutions of about 3.7 M silver nitrate and about 3.8 M sodium chloride were then added by conventional controlled double-jet addition at a constant silver nitrate flow rate of about 104.4 milliliters/minute for about 1.28 minutes while maintaining pCl constant at about 1.05. A 1.0 minute rest period followed nucleation. The remainder of the silver nitrate and sodium chloride for growth of 91% of the core of the grain was delivered with five double-jet pulses at the flow rate of about 234 milliliters/minute separated by hold periods. The duration of the pulses were 0.75, 0.75, 3.0, 5.03, and 3.0 minutes, respectively. There was a period of rest after each successive pulse. The duration of rests were 5, 3, 3, 3, and 2 minutes, respectively. Both the silver nitrate and sodium chloride solution pumps were then turned off and about 0.8 M potassium iodide solution was added to the stirred reaction mixture over about 0.5 min at a constant flow rate of about 62.5 milliliters/min. Following a 0.5 min rest period, the resultant iodochloride emulsion was then grown further by pulsed controlled double-jet addition for about 1.3 minutes by resumed addition of silver and sodium salt solutions at about 226 mL/min at a pCl of about 1.05. The solution was then held for one minute. The stirring speed of the stirring device was maintained at 2250 revolutions per minute (RPM) during the entire precipitation process. In addition, $CS_2Os(NO)Cl_5$ was added at approximately 35 to 71%, and $K_4Ru(CN)_6$ at approximately 75 to 80% into the precipitation. A total of 12.5 moles of a silver iododchloride emulsion was thus prepared with 0.2 mole % iodide added at 91% of total grain volume. Cubic edge length was 0.6 $\mu$m.

Iridium doped emulsions were precipitated similarly as above, except that $K_2[IrCl_5$ (5-Bromo thiazole)], $K_2[IrCl_5$ (5-Methyl-Thiazole)] or $K_2[IrCl_6]$ were added during precipitation during to 85 to 88% of grain formation at the levels specified in Table 2.3.1.

A portion of each silver iododchloride was optimally sensitized by the addition of p-glutaramidophenyldisulfide followed by the addition of a colloidal suspension of aurous sulfide and heat ramped to 60° C., after which time blue sensitizing dye E, Lippmann bromide, and 1-(3-acetamidophenyl)-5-mercaptotetrazole were added.

Spectral Sensitizing Dye E

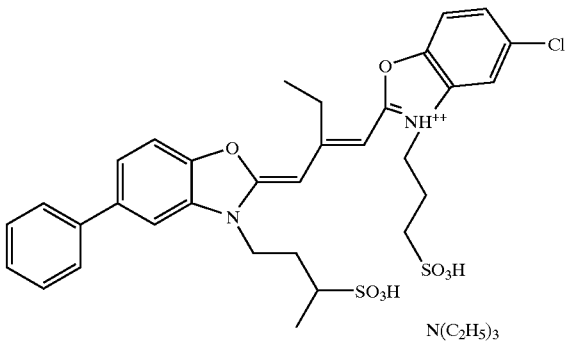

Blue sensitized emulsions were coated at 20.5 milligrams silver per foot square along with a dispersion of yellow dye forming coupler D at 38 milligrams per foot square in a conventional single layer coating format on reflective support. The coatings were overcoated with a gelatin layer and the entire coating was hardened with bis(vinylsulfonylmethyl)ether.

Coupler D

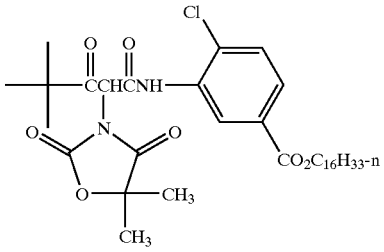

Sample coatings were exposed to a 3000° K light source through a 0–3 optical density step tablet to generate the characteristic sensitometric response. Exposure times of 0.31 seconds, 0.5 second and 128 seconds were made along with the appropriate neutral density filters to maintain a fixed absolute exposure amount. Sensitometry independent of exposure time (adherence to Reciprocity Law behavior) is a desired result. The coatings were then processed using Kodak™ Ektacolor RA-4 processing chemistry about 5 minutes after exposure. Coatings exposed for 0.5 seconds were also held for 2 hour and 24 hour periods prior to processing to assess the stability of the latent image. No change in sensitivity due to a delay between exposure and processing is the preferred result.

Sensitometric results are given in Tables 2.3.1–2.3.4 below. Speed is taken as the logarithm of the inverse of the amount of light required to produce a reflection optical density of 0.8. A two fold difference in speed is reflected in a 30 unit speed difference. Contrast is measured by the Shoulder Density, which is defined as the density at an exposure of 0.4 logE greater than that necessary to produce a reflection density of 0.8. A higher Shoulder Density corresponds to an increase in contrast. Toe Density is a measure of lower-scale contrast, and is defined as the density at an exposure of 0.2 logE less than that necessary to produce a reflection density of 0.8. A higher Toe Density corresponds to a decrease in contrast. LoToe Density is another measure of lower-scale contrast, and is defined as the density at an exposure of 0.4 loge less than that necessary to produce a reflection density of 0.8. A higher LoToe Density also corresponds to a decrease in contrast. Departure from Reciprocity Law behavior is given by calculating the difference in the sensitometric parameters at exposure times of 128 seconds and 0.031 seconds. A relative loss in Speed or contrast under low intensity exposure conditions is common and is termed Low Intensity Reciprocity Failure (LIRF). No LIRF or a reduction in LIRF is desirable.

TABLE 2.3.1

| Iridium Dopant | Dopant Amount (ppb) | Speed | Speed LIRF | Shoulder LIRF | Toe LIRF | LoToe LIRF |
|---|---|---|---|---|---|---|
| None (comp) | 0 | 137 | −22 | 0.023 | −0.030 | −0.045 |
| $K_2IrCl6$ (comp) | 62 | 149 | −3 | 0.077 | 0.023 | −0.016 |
| $K_2IrCl_5$(5-Me thiazole) (comp) | 62 | 159 | −7 | 0.096 | −0.024 | 0.016 |
| $K_2IrCl_5$(5-Br thiazole) (invention) | 62 | 160 | −2 | −0.001 | 0.003 | −0.003 |
| $K_2IrCl_5$(5-Me thiazole) (comp) | 124 | 162 | −4 | −0.023 | −0.005 | −0.004 |
| $K_2IrCl_5$(5-Br thiazole) (Invention) | 124 | 159 | −5 | −0.030 | 0.001 | 0.000 |

The results in Table 2.3.1 show that in comparison to equimolar amounts of either the $K_2IrCl_6$ or the $K_2IrCl_5$(5-methylthiazole) dopant, the sensitometric results for the inventive $K_2IrCl_5$(5-bromothiazole) dopant show comparable or improved Speed and Speed LIRF, and a substantial improvement (reduction) in Toe LIRF and LoToe LIRF.

Latent image stability results for coatings given a 0.5 second exposure are given in Tables 2.3.2 and 2.3.3 below. The quality of photographic prints can be degraded by changes in sensitometry that occur due to variability in the delay time between exposure and processing that commonly arise in practical printing situations. An increase in Speed may darken the overall appearance of a print or adversely affect the color balance. Changes in contrast may have similar undesirable effects on the highlight and shadow regions of prints. Therefore it is desirable to eliminate or reduce latent image instabilities. Speed, Shoulder Density, Toe Density and LoToe Density parameters are defined above.

TABLE 2.3.2

| Iridium Dopant | Dopant Amount (ppb) | Delta Speed (2 Hr-5 Min) | Delta Speed (24 Hr-5 Min) | Delta Shoulder (2 Hr-5 Min) | Delta Shoulder (24 Hr-5 Min) |
|---|---|---|---|---|---|
| None (comp) | 0 | 0.2 | −1.4 | −0.01 | 0.00 |
| $K_2IrCl6$ (comp) | 62 | 3.5 | 3.7 | 0.10 | 0.13 |
| $K_2IrCl_5$(5-Me thiazole) (comp) | 62 | 2.2 | 1.3 | 0.04 | 0.04 |
| $K_2IrCl_5$(5-Br thiazole) (invention) | 62 | 0.4 | −0.7 | 0.02 | 0.01 |
| $K_2IrCl_5$(5-Me thiazole) (comp) | 124 | 2.1 | 1.5 | 0.05 | 0.06 |
| $K_2IrCl_5$(5-Br thiazole) (Invention) | 124 | 0.9 | 0.8 | 0.02 | 0.03 |

TABLE 2.3.3

| Iridium Dopant | Dopant Amount (ppb) | Delta Toe (2 Hr-5 Min) | Delta Toe (24 Hr-5 Min) | Delta LoToe (2 Hr-5 Min) | Delta LoToe (24 Hr-5 Min) |
|---|---|---|---|---|---|
| None (comp) | 0 | −0.005 | −0.005 | −0.005 | −0.010 |
| $K_2IrCl6$ (comp) | 62 | −0.013 | −0.017 | −0.011 | −0.013 |
| $K_2IrCl_5$(5-Me thiazole) (comp) | 62 | −0.013 | −0.018 | −0.015 | −0.018 |
| $K_2IrCl_5$(5-Br thiazole) (invention) | 62 | −0.005 | −0.009 | −0.005 | −0.007 |

TABLE 2.3.3-continued

| Iridium Dopant | Dopant Amount (ppb) | Delta Toe (2 Hr-5 Min) | Delta Toe (24 Hr-5 Min) | Delta LoToe (2 Hr-5 Min) | Delta LoToe (24 Hr-5 Min) |
|---|---|---|---|---|---|
| $K_2IrCl_5$(5-Me thiazole) (comp) | 124 | −0.016 | −0.021 | −0.015 | −0.020 |
| $K_2IrCl_5$(5-Br thiazole (Invention) | 124 | −0.005 | −0.011 | −0.005 | −0.010 |

The problem of latent image instability commonly encountered with iridium doped precipitations is illustrated by comparing the non-iridium doped emulsion to any of the iridium doped emulsions. The benefits of reduced reciprocity law failure is often accompanied by degraded latent image stability. However, in comparison to equimolar amounts of either the $K_2IrCl_6$ or the $K_2IrCl_5$(5-methylthiazole) dopant, the latent image stability results contained in Tables 2.3.2 and 2.3.3 above for the inventive $K_2IrCl_5$(5-bromothiazole) dopant show consistent improvement (reduction) in Speed, Shoulder, Toe and LoToe changes at both the 2 hour and 24 hour delay times. Overall, a very significant improvement in latent image stability is demonstrated for the $K_2IrCl_5$(5-bromothiazole) dopant.

In addition, sample coatings were exposed with a blue laser device consisting of an Argon ion laser with output at 467.5 nm, an exposure resolution of 196.8 pixels/cm, a pixel pitch of 50.8 um, and an exposure time of 1 microsecond per pixel. The coatings were then processed using Kodak™ Ektacolor RA-4 processing chemistry about 20 seconds after exposure. Exposed coatings were also held for 2 hours prior to processing to assess the stability of the latent image formed as a result of laser exposure. No change in sensitivity due to a delay between exposure and processing is the preferred result. Sensitometric results for laser exposures are given in Table 2.3.4 below. Preservation of upper-scale contrast (Shoulder Density) is important to maintain excellent sharpness of fine lines and detail in photographic prints produced in laser printers. Therefore it is desirable to reduce or eliminate any loss in Shoulder Density between laser and optical exposure times.

TABLE 2.3.4

| Iridium Dopant | Dopant Amount (ppb) | (laser-optical) Shoulder Density | Delta Toe (2 Hr-20 sec) | Delta LoToe (2 Hr-20 sec) |
|---|---|---|---|---|
| None (comp) | 0 | −0.26 | −0.002 | −0.003 |
| $K_2IrCl6$ (comp) | 62 | −0.14 | −0.037 | −0.032 |
| $K_2IrCl_5$(5-Me thiazole) (comp) | 62 | −0.13 | −0.019 | −0.020 |
| $K_2IrCl_5$(5-Br thiazole) (invention) | 62 | −0.06 | −0.015 | −0.014 |
| $K_2IrCl_5$(5-Me thiazole) (comp) | 124 | −0.04 | −0.022 | 0.019 |
| $K_2IrCl_5$(5-Br thiazole) (Invention) | 124 | −0.07 | −0.015 | −0.013 |

Results in Table 2.3.4 above show that the $K_2IrCl_5$(5-bromothiazole) dopant has a similar or superior effect relative to the comparison dopants in preserving the Shoulder Density at laser exposure times. In addition, in comparison to equimolar amounts of either the $K_2IrCl_6$ or the $K_2IrCl_5$ (5-methylthiazole) dopant, the latent image stability results for the inventive $K_2IrCl_5$(5-bromothiazole) dopant show consistent improvement (reduction) in lower-scale contrast (Toe and LoToe) changes. Overall, a very significant improvement in latent image stability for laser exposure is demonstrated for the $K_2IrCl_5$(5-bromothiazole) dopant.

Example 2.4

Yellow Paper Example

Emulsions were prepared similarly as in Example 2.3, with iridium dopant levels as specified in Table 2.4, except that $K_2IrCl_6$ was additionally added just prior to the Lippmann bromide during the chemical sensitization process. Emulsions in this example demonstrate that many of the advantages of the $K_2IrCl_5$(5-bromothiazole) dopant are preserved when additional iridium dopant is added to the emulsions as part of the chemical sensitization process.

Sample coatings were prepared, exposed, processed and analyzed as described in Example 2.3 above. Sensitometric results are shown in Table 2.4 below wherein optical exposure parameters are for a 0.1 second exposure time. Stability of latent image formed from laser exposure was assessed by comparing coatings exposed and then held for 20 seconds, 2 hours and 24 hours prior to processing.

TABLE 2.4

| Iridium Dopant | Dopant Amount (ppb) | Optical Speed | Optical Shlder | Laser Shlder | Laser Delta Speed (2 Min-20") | Laser Delta Speed (2 Hr-20") | Laser Delta Speed (24 Hr-20") |
|---|---|---|---|---|---|---|---|
| None (comp) | 0 | 166 | 1.83 | 1.37 | 1.2 | 7.1 | 3.7 |
| $K_2IrCl_5$(5-Me tz) (comp) | 62 | 172 | 2.08 | 2.00 | 0.5 | 3.8 | 2.3 |
| $K_2IrCl_5$(5-Br tz) (invention) | 62 | 168 | 2.22 | 2.18 | 0.2 | 1.4 | 1.2 |
| $K_2IrCl_5$(5-Me tz) (comp) | 124 | 172 | 2.18 | 2.13 | 0.4 | 3.6 | 2.3 |
| $K_2IrCl_5$(5-Br tz) (Invention) | 124 | 168 | 2.21 | 2.17 | 0.3 | 1.7 | 1.6 |

Results in Table 2.4 above show that the $K_2IrCl_5$(5-bromothiazole) dopant has comparable speed and superior upper-scale contrast (higher Shoulder Density) for both optical and laser exposures. In addition, in comparison to an equimolar amount of the $K_2IrCl_5$(5-methylthiazole) dopant, the latent image stability results for the inventive $K_2IrCl_5$ (5-bromothiazole) dopant show consistent improvement (reduction) in Speed changes for delays of 2 and 24 hours. Overall, a very significant improvement in latent image stability for laser exposure is demonstrated for the $K_2IrCl_5$ (5-bromothiazole) dopant.

Example 2.5

Yellow Paper Example

To a reactor incorporating a stirring device as disclosed in *Research Disclosure*, Item 38213, and containing 8.921 grams of distilled water, 25 milligrams of p-glutaramidophenyldisulfide and 250 grams of bone gelatin, were added 294 grams of 3.8 M sodium chloride salt solution such that the mixture was maintained at a pCl of about 1.05 at approximately 68° C. To this were added 1.9 grams of 1,8-dihydroxy-3,6-dithiaoctane approximately 30 seconds before commencing introduction of silver and chloride salt solutions. Aqueous solutions of about 3.7 M silver nitrate and about 3.8 M sodium chloride were then added by conventional controlled double-jet addition at a constant silver nitrate flow rate of about 234 milliliters/minute for about 2.0 minutes while maintaining pCl constant at about 1.05. A 3.0 minute rest period followed nucleation. The remainder of the silver nitrate and sodium chloride for growth of 91% of the core of the grain was delivered with three double-jet pulses at the flow rate of about 234 milliliters/minute separated by hold periods. The duration of the pulses were 3.0, 5.0 and 3.0 minutes, respectively. There was a period of rest after each successive pulse. The duration of rests were 3, 3, and 2 minutes, respectively. Both the silver nitrate and sodium chloride solution pumps were then turned off and about 0.8 M potassium iodide solution was added to the stirred reaction mixture over about 0.5 min at a constant flow rate of about 62.5 milliliters/min. Following a 0.5 min rest period, the resultant iodochloride emulsion was then grown further by pulsed controlled double-jet addition for about 1.3 minutes by resumed addition of silver and sodium salt solutions at about 226 mL/min at a pCl of about 1.05. The solution was then held for one minute. The stirring speed of the stirring device was maintained at 2250 revolutions per minute (RPM) during the entire precipitation process. In addition, $Cs_2Os(NO)Cl_5$ was added at approximately 35 to 71% of the grain volume. A total of 12.5 moles of a silver iododchloride emulsion was thus prepared with 0.2 mole % iodide added at 91% of total grain volume. Cubic edge length was about 0.46 $\mu$m.

Iridium doped emulsions were precipitated similarly as above, except that $K_2[IrCl_5$ (5-Bromo thiazole)] or $K_2[IrCl_5$ (5-Methyl-Thiazole)] were added during precipitation during to 85 to 88% of grain formation at the levels specified in Table 2.5.

A portion of each silver iododchloride was optimally sensitized by the addition of p-glutaramidophenyldisulfide followed by the addition of a colloidal suspension of aurous sulfide and heat ramped to 60° C., after which time blue sensitizing dye E, $K_2IrCl_6$, Lippmann bromide, and 1-(3-acetamidophenyl)-5-mercaptotetrazole were added.

Blue sensitized emulsions of Example 2.5 were coated at 20.5 milligrams silver per foot square along with a dispersion of yellow coupler D at 38 milligrams per foot square in a conventional single layer coating format on reflective support. The coatings were overcoated with a gelatin layer and the entire coating was hardened with bis(vinylsulfonylmethyl)ether. Sample coatings were exposed to a 3000° K light source through a 0–3 optical density step tablet to generate the characteristic sensitometric response. Exposure times of 0.5 seconds and 512 seconds were made along with the appropriate neutral density filters to maintain a fixed absolute exposure amount. Sensitometry independent of exposure time (adherence to Reciprocity Law behavior) is the desired result. The coatings were then processed using Kodak™ Ektacolor RA-4 processing chemistry.

Sensitometric results are given in Table 2.5 below. Speed, Shoulder Density, Toe Density and LoToe Density parameters are as defined above in Example 2.3. Departure from Reciprocity Law behavior is given by calculating the difference in the sensitometric parameters at exposure times of 512 seconds and 0.5 seconds. A relative loss in Speed or contrast under low intensity exposure conditions is common and is termed Low Intensity Reciprocity Failure (LIRF). No LIRF or a reduction in LIRF (closer to zero) is desirable.

TABLE 2.5

| Iridium Dopant | Dopant Amount (ppb) | Speed | Speed LIRF | Shoulder LIRF | Toe LIRF | LoToe LIRF |
|---|---|---|---|---|---|---|
| None (comp) | 0 | 137 | −11 | −0.406 | 0.044 | 0.033 |
| $K_2IrCl_5$(5-Me tz) (invention) | 198 | 130 | −13 | −0.257 | 0.041 | 0.031 |
| $K_2IrCl_5$(5-Br tz) (invention) | 198 | 133 | −8 | −0.160 | 0.027 | 0.022 |

In comparison to either a non-iridium doped or an equimolar $K_2IrCl_5$(5-methylthiazole) doped precipitation, the sensitometric results shown in Table 2.5 for the inventive $K_2IrCl_5$(5-bromothiazole) dopant show comparable Speed with improvement (reduction) in Speed LIRF, Shoulder LIRF, Toe LIRF and LoToe LIRF.

Example 2.6

Yellow Paper Example

Emulsions were prepared similarly as in Example 2.5, with iridium dopant levels as specified in Table 2.6, except that 3.87 micromoles of $K_4Ru(CN)_6$ was also added at approximately 75 to 80% of the grain volume. Emulsions in this example demonstrate the relative advantages of the $K_2IrCl_5$(5-bromothiazole) dopant in a 0.46 micron cubic emulsion that is also doped with $K_4Ru(CN)_6$.

Portions of the silver iododchloride emulsions of Example 2.6 were optimally sensitized by the addition of p-glutaramidophenyldisulfide, followed by the addition of a colloidal suspension of aurous sulfide and heat ramped to 60° C., after which time blue sensitizing dye E, $K_2IrCl_6$, Lippmann bromide, and 1-(3-acetamidophenyl)-5-mercaptotetrazole were added.

Sample coatings were prepared, exposed, processed and analyzed as described in Example 2.5 above. Speed, Shoulder density and Toe density parameters are defined above. Speed and reciprocity law characteristics are given in Table 2.6.1 below. A reduction in LIRF (closer to zero) is desirable.

TABLE 2.6.1

| Iridium Dopant | Dopant Amount | Speed | Speed LIRF | Shoulder LIRF | Toe LIRF | LoToe LIRF |
|---|---|---|---|---|---|---|
| None (Comp) | 0 | 131 | −19 | −0.40 | 0.069 | 0.050 |
| $K_2IrCl_5$ (5-Me tz) (Comp) | 99 ppb | 134 | −11 | −0.22 | 0.033 | 0.026 |
| $K_2IrCl_5$ (5-Br tz) (Invention) | 99 ppb | 130 | −8 | −0.12 | 0.020 | 0.016 |
| $K_2IrCl_5$ (5-Me tz) (Comp) | 198 ppb | 134 | −8 | −0.17 | 0.029 | 0.021 |
| $K_2IrCl_5$ (5-Br tz) (Invention) | 198 ppb | 115 | −7 | −0.12 | 0.028 | 0.018 |
| $K_4IrCl_5$ (5-Me tz) (Comp) | 396 ppb | 132 | −8 | −0.12 | 0.018 | 0.013 |
| $K_2IrCl_5$ (5-Br tz) (Invention) | 396 ppb | 122 | −5 | −0.08 | 0.017 | 0.013 |
| $K_4IrCl_5$ (5-Me tz) (Comp) | 497 ppb | 128 | −6 | −0.09 | 0.013 | 0.014 |
| $K_2IrCl_5$ (5-Br tz) (Invention) | 497 ppb | 124 | −3 | −0.06 | 0.013 | 0.007 |

In comparison to either a non-iridium doped or an equimolar $K_2IrCl_5$(5-methylthiazole) doped precipitation, the results in Table 2.6.1 show the inventive $K_2IrCl_5$(5-methyloxazole) dopant to be comparable in Speed with greatly improved (reduced) Speed LIRF and Shoulder. LIRF, and improved or equal Toe LIRF and LoToe LIRF.

Latent image stability results are given in Table 2.6.2 below. The quality of photographic prints can be degraded by changes in sensitometry that occur due to variability in the delay time between exposure and processing that commonly arise in practical printing situations. An increase in Speed may darken the overall appearance of a print or adversely affect the color balance. Therefore it is desirable to reduce or eliminate latent image instabilities.

TABLE 2.6.2

| Iridium Dopant | Dopant Amount (ppb) | Delta Speed (2 Hr-5 Min) | Delta Speed (24 Hr-5 Min) |
|---|---|---|---|
| None (Comp) | 0 | −0.1 | −0.4 |
| $K_2IrCl_5$(5-Me tz) (Comp) | 198 | 1.7 | 1.9 |
| $K_2IrCl_5$(5-Br tz) (Invention) | 198 | 0.1 | −0.4 |
| $K_4IrCl_5$(5-Me tz) (Comp) | 396 | 2.3 | 2.6 |
| $K_2IrCl_5$(5-Br tz) (Invention) | 396 | −0.5 | −0.4 |
| $K_4IrCl_5$(5-Me tz) (Comp) | 497 | 3.5 | 3.4 |
| $K_2IrCl_5$(5-Br tz) (Invention) | 497 | 0.3 | 0.8 |

Once more the problem of latent image instability traditionally encountered with iridium doped precipitations is illustrated by comparing the non-iridium doped emulsion to any of the iridium doped emulsions. The benefits of reduced reciprocity law failure is often accompanied by degraded latent image stability. However, in comparison to equimolar amounts of the $K_2IrCl_5$(5-methylthiazole) dopant, the latent image stability results for the inventive $K_2IrCl_5$(5-methyloxazole) dopant show consistent improvement (reduction) in Speed changes at both the 2 hour and 24 hour delay times. Overall, a very significant improvement in latent image stability is shown for the $K_2IrCl_5$(5-bromothiazole) dopant relative to the $K_2IrCl_5$(5-methylthiazole) dopant.

Example 3

Emulsions for Photothermographic Film

The following example demonstrates the usefulness, in high bromide photothermographic tabular grain emulsions, of iridium dopants comprising a 5-halo substituted thiazole ligand in accordance with the invention. The examples show the usefulness of $[IrCl_5(5\text{-Br tz})]^{2-}$ compared to $[IrCl_6]^{3-}$ for reducing LIRF with minimal speed loss.

Preparation of Tabular Grain Silver Halide Emulsions:

A vessel equipped with a stirrer was charged with 6 liters of water containing 4.21 g of lime-processed bone gelatin, 4.63 g sodium bromide, 75.6 mg of potassium iodide, an antifoamant, and 1.25 ml of 0.1 molar sulfuric acid. It was then held at 39° C. for 5 minutes. Simultaneous additions were then made of 25.187 ml of 0.6 molar silver nitrate and 19.86 ml of 0.75 molar sodium bromide over 30 seconds. Following nucleation, 50 ml of a 0.58% solution of the oxidant Oxone was added. Next a mixture of 0.749 g of sodium thiocyanate and 30.22 g of sodium chloride dissolved in 136.4 g of water were added and the temperature was increased to 54° C. over 9 minutes. After a 5-minute hold, 100 g of oxidized methionine lime-processed bone gelatin in 1.412 liters of water containing additional antifoamant at 54° C. were then added to the reactor. During the next 38 minutes, the first growth stage took place wherein solutions of 0.6 molar $AgNO_3$, 0.75 molar sodium bromide, and a 0.29 molar suspension of silver iodide (Lippmann) were added to maintain a nominal uniform iodide level of 4.2 mole %. The flow rates during this growth segment were linearly increased from 9 to 42 ml/min (silver nitrate), from 11.4 to 48.17 ml/min (sodium bromide) and from 0.8 to 3.7 ml/min (silver iodide). The flow rates of the sodium bromide were unbalanced from the silver nitrate in order to increase the pBr during the segment During the next 64 minutes the second growth stage took place wherein solutions of 3.5 molar silver nitrate and 4.5 molar sodium bromide and a 0.29 molar suspension of silver iodide (Lippmann) were added to maintain a nominal iodide level of 4.2 mole %. The flow rates during this segment were increased from 8.6 to 38 ml/min (silver nitrate) and from 5.2 to 22.0 ml/min (silver iodide). The flow rates of the sodium bromide were allowed to fluctuate as needed to maintain a constant pBr. During the next 38 minutes, the third growth stage took place wherein solutions of 3.5 molar silver nitrate and 4.5 molar sodium bromide and a 0.29 molar suspension of silver iodide (Lippmann) were added to maintain a nominal iodide level of 4.2 mole %. The flow rates during this segment were 42 ml/min (silver nitrate), nominally-32 ml/min (sodium bromide)-pBr control, and 22 ml/min (silver iodide). The temperature was decreased from 54° C. to 35° C. during this segment. At a point approx. 13.5 minutes after the start of this segment, a 1 ml aqueous solution of dopant (containing the appropriate dopant type and concentration for the nominal ppb level desired) was added. A total of 12.6 moles of silver iodobromide (4.2% bulk iodide) were formed. The resulting emulsion was washed via ultrafiltration. Lime-processed bone gelatin (269.3 g) was added along with a biocide and pH and pBr were adjusted to 6 and 2.5 respectively. The resulting emulsion was examined by Scanning Electron Microscopy. Tabular grains accounted for greater than 99% of the total projected area. The mean ECD of the grains was 2.73 μm. The mean tabular thickness was 0.063 μm.

Using the above emulsion formulation, AgBrI tabular grain emulsions were obtained doped with either $[IrCl_5(5\text{-Br thiazole})]^{2-}$ or $[IrCl_6]^{3-}$ at concentrations as indicated in Table 3.2 below. Also, in a control emulsion, water was used in place of any Ir dopant solution.

Samples of each emulsion were further sensitized using a sulfur sensitizer (compound SS-1 as described in U.S. Pat. No. 6,296,998 of Eikenberry et al.) at 60° C. for 10 minutes, and 2.0 mmol of blue sensitizing dye F (shown below) per mole of silver halide was added before the chemical sensitizers.

Spectral Sensitizing Dye F

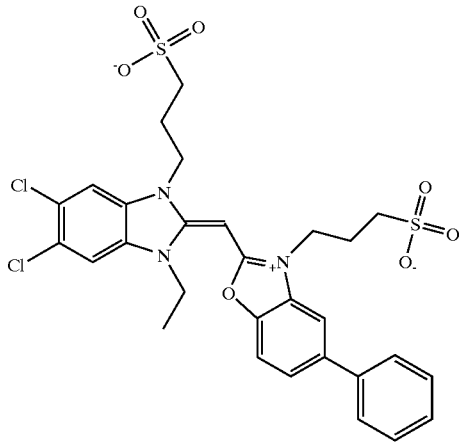

Preparation of Silver Benzotriazole Salt Dispersion:

A stirred reaction vessel was charged with 85 g of lime-processed gelatin, 25 g of phthalated gelatin, and 2000 g of deionized water. A solution containing 185 g of benzotriazole, 1405 g of deionized water, and 680 g of 2.5 molar sodium hydroxide was prepared (Solution B). The mixture in the reaction vessel was adjusted to a pAg of 7.25 and a pH of 8.0 by addition of Solution B, and 2.5 molar sodium hydroxide solution as needed, and maintaining it at temperature of 36° C. A solution containing 228.5 g of silver nitrate and 1222 g of deionized water (Solution C) was added to the kettle at the accelerated flow rate defined by: $Flow=16(1+0.002t^2)$ ml/min (where t is the time in minutes), and the pAg was maintained at 7.25 by a simultaneous addition of Solution B. This process was terminated when Solution C was exhausted, at which point a solution of 80 g of phthalated gelatin and 700 g of deionized water at 40° C. was added to the kettle. The mixture was then stirred and the pH was adjusted to 2.5 with 2 molar sulfuric acid to coagulate the silver salt emulsion. The coagulum was washed twice with 5 liters of deionized water, and redispersed by adjusting pH to 6.0 and pAg to 7.0 with 2.5 molar sodium hydroxide solution and Solution B. The resulting silver salt dispersion contained fine particles of silver benzotriazole salt.

Preparation of Photothermographic Imaging Layer:

Photothermographic emulsions were prepared containing the components in the Table 3.1. Each formulation was coated as a single layer on a 7 mil (178 μm) transparent, blue-tinted poly(ethylene terephthalate) film support using a conventional coating machine.

TABLE 3.1

| Component | Dry Coverage |
|---|---|
| Silver benzotriazole | 4.22 $g/m^2$ |
| AgBrI tabular grains | 0.67 $g/m^2$ |
| Sodium benzotriazole | 0.10 $g/m^2$ |
| 3-Methylbenzothiazolium iodide | 0.08 $g/m^2$ |
| Succinimide | 0.13 $g/m^2$ |
| 1,3-Dimethylurea | 0.13 $g/m^2$ |
| 4-Benzyl-1,2,4-triazole-3-thiol | 0.05 $g/m^2$ |
| L-Ascorbic acid | 1.82 $g/m^2$ |
| Phthalazine and phthalazine compounds | 0.24 $mmol/m^2$ |
| Lime processed gelatin | 3.65 $g/m^2$ |

The resulting photothermographic films were imagewise exposed for from 10 to $10^{-4}$ seconds (six decades) using a reciprocity sensitometer equipped with a W-2b filter. Following exposure, the films were developed by heating on a heated drum for 18 seconds at 150° C. to generate stepped patches. Transmission densitometry measurements were made on a standard densitometer and using a filter appropriate to the sensitivity of the photothermographic material to obtain graphs of density versus log exposure (D log E curves). Dmin is the density of the non-exposed areas after development. Relative speeds were determined at a density value of 0.2 above $D_{min}$ and they are in log terms. Results are summarized in Table 3.2.

TABLE 3.2

| Dopant | | Level | Speed (0.1 sec exp) | Speed (1 sec exp) |
|---|---|---|---|---|
| no dopant | comparison | 0 | 219 | 182 |
| $[IrCl_6]^{2-}$ | comparison | 6 ppb | 200 | 201 |
| $[IrCl_6]^{2-}$ | comparison | 20 ppb | 177 | 201 |
| $[IrCl_5(5\text{-Br thiazole})]^{2-}$ | example | 164 ppb | 210 | 213 |

Use of $[IrCl_6]^{2-}$ at relatively low levels improves reciprocity performance, at a cost of speed for shorter exposure times. Increasing $[IrCl_6]^{2-}$ levels results in further speed loss at shorter exposure times, and poorer reciprocity performance. Use of $[IrCl_5(5\text{-Br thiazole})]^{2-}$, on the other hand, surprisingly and advantageously results in improved reciprocity with less of the speed loss at shorter exposure times that is associated with doping with Iridium hexachloride.

The invention has been described in detail with particular reference to certain preferred embodiments thereof, but it will be understood that variations and modifications can be effected within the spirit and scope of the invention.

What is claimed is:

1. A silver halide emulsion comprising radiation sensitive silver halide grains exhibiting a face centered cubic crystal lattice structure containing a hexacoordination complex of an iridium ion in which at least half of the coordination sites in the hexacoordination complex are provided by halogen or pseudohalogen ligands, and at least one coordination site is provided by a ligand comprising a heterocyclic azole ring containing a chalcogen atom and a nitrogen atom, wherein the azole ring is substituted at the 5-position with a halide ion.

2. An emulsion according to claim 1, wherein the iridium hexacoordination complex is represented by the Formula I:

$$[IrX'_{6-a-b}T_aL_b]^n$$

where Ir represents iridium(III) or iridium (IV) ions); each X' is a halide or pseudohalide ion or any mixture of these; subscript a is 1, 2 or 3; each L represents a ligand which is distinct from X' and T; subscript b is 0, 1 or 2; the sum of subscripts a and b is 1 to 3; n represents the net charge of the coordination complex; and each T represents a ligand of the formula:

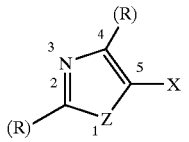

wherein Z represents a chalcogen atom; X represents a fluoride, chloride, bromide, or iodide ion, and each R independently represents H or a substituent.

3. An emulsion according to claim 2, wherein Ir represents iridium (III).

4. An emulsion according to claim 3, wherein subscript a represents 1 or 2, and subscript b represents 0 or 1.

5. An emulsion according to claim 4, wherein subscript a represents 1.

6. An emulsion according to claim 5, wherein subscript b represents 0.

7. An emulsion according to claim 2, wherein Z represents oxygen or sulfur.

8. An emulsion according to claim 2, wherein Z represents sulfur.

9. An emulsion according to claim 2, wherein half or more of X' ligands are halide ligands.

10. An emulsion according to claim 2, wherein all the X' ligands are halide ligands.

11. An emulsion according to claim 2, wherein half or more of the X' ligands are chloride ligands.

12. An emulsion according to claim 2, wherein half or more of the X' ligands are bromide ligands.

13. An emulsion according to claim 2, wherein b represents 1 and L is selected from NO, NS, CO, O, HOH, and $NH_3$.

14. An emulsion according to claim 2, wherein X represents a chloride or a bromide ion.

15. An emulsion according to claim 2, wherein X represents a bromide ion.

16. An emulsion according to claim 1, wherein the iridium coordination complex dopant is selected from $[IrCl_5(5\text{-chloro thiazole})]^{2-}$, $[IrCl_5(5\text{-bromo thiazole})]^{2-}$, $[IrCl_4(5\text{-bromo thiazole})_2]^{1-}$, and $[IrBr_5(5\text{-bromo thiazole})]^{2-}$.

17. An emulsion according to claim 1, wherein the iridium coordination complex dopant is $[IrCl_5(5\text{-bromo thiazole})]^{2-}$.

18. An emulsion according to claim 1, wherein the iridium coordination complex dopant is $[IrCl_5(5\text{-chloro thiazole})]^{2-}$.

19. An emulsion according to claim 1, wherein the iridium coordination complex dopant is $[IrCl_4(5\text{-bromo thiazole})_2]^{1-}$.

20. An emulsion according to claim 1, wherein the iridium coordination complex dopant is $[IrBr_5(5\text{-bromo thiazole})]^{2-}$.

21. An emulsion according to claim 1, wherein the silver halide grains are chosen from among silver bromide, silver iodobromide, silver chlorobromide, silver iodochlorobromide, silver chloroiodobromide, silver chloride, silver bromochloride, silver iodochloride, silver bromoiodochloride, and silver iodobromochloride.

22. A color negative film photographic element comprising a support having coated thereon at least one iridium doped emulsion according to claim 1, wherein the emulsion comprises high bromide tabular grains.

23. A color negative film element according to claim 22, wherein the iridium doped emulsion comprises at least 70 mole percent bromide, 0–30 mole percent iodide, and 0–30 mole percent chloride, based on total silver.

24. A color negative film element according to claim 23, wherein the iridium doped emulsion comprises at least 80 mole percent bromide, 0–15 mole percent chloride, and 0.25–15 mole percent iodide.

25. A photothermographic element comprising a support having coated thereon at least one iridium doped emulsion according to claim 1, wherein the emulsion comprises high bromide tabular grains.

26. A photothermographic element according to claim 25, wherein the iridium doped emulsion comprises at least 70 mole percent bromide, 0–30 mole percent iodide, and 0–30 mole percent chloride, based on total silver.

27. A photothermographic element according to claim 26, wherein the iridium doped emulsion comprises at least 80 mole percent bromide, 0–15 mole percent chloride, and 0.25–15 mole percent iodide.

28. A color paper photographic element comprising a support having coated thereon at least one iridium doped emulsion according to claim 1, wherein the emulsion comprises high chloride cubical grains.

29. A color paper element according to claim 28, wherein the iridium doped emulsion comprises at least 70 mole percent chloride, 0–30 mole percent chloride, and 0–10 mole percent iodide, based on total silver.

30. A color paper element according to claim 29, wherein the iridium doped emulsion comprises at least 90 mole percent chloride, 0–10 mole percent bromide, and 0–5 mole percent iodide.

* * * * *